US009850666B2

(12) United States Patent
Libreiro et al.

(10) Patent No.: US 9,850,666 B2
(45) Date of Patent: Dec. 26, 2017

(54) PANEL SYSTEM FOR COVERING A BUILDING WALL

(71) Applicant: Carter Architectural Panels Inc., Brampton (CA)

(72) Inventors: Miguel Antonio Moore Libreiro, Ajax (CA); Joel Adam McKinley, Orangeville (CA)

(73) Assignee: CARTER ARCHITECTURAL PANELS INC., Brampton (CA)

( * ) Notice: Subject to any disclaimer, the term of this patent is extended or adjusted under 35 U.S.C. 154(b) by 0 days.

(21) Appl. No.: 14/701,610

(22) Filed: May 1, 2015

(65) Prior Publication Data

US 2015/0345152 A1 Dec. 3, 2015

Related U.S. Application Data

(60) Provisional application No. 62/132,253, filed on Mar. 12, 2015, provisional application No. 62/005,148, filed on May 30, 2014.

(51) Int. Cl.

| | |
|---|---|
| ***E04F 13/18*** | (2006.01) |
| ***E04F 13/08*** | (2006.01) |
| ***E04F 13/12*** | (2006.01) |

(52) U.S. Cl.

CPC ..... *E04F 13/0816* (2013.01); *E04F 13/0848* (2013.01); *E04F 13/0875* (2013.01); *E04F 13/0891* (2013.01); *E04F 13/0898* (2013.01); *E04F 13/12* (2013.01)

(58) Field of Classification Search

CPC ..... E04F 13/0823; E04F 13/0814; E04F 13/0891; E04F 13/0816; E04F 13/12; E04F 13/0848; E04F 13/0875; E04F 13/0898; E04B 2/88; E04B 2/90; E04B 2/96

See application file for complete search history.

(56) References Cited

U.S. PATENT DOCUMENTS

| | | | | |
|---|---|---|---|---|
| 640,593 A | | 1/1900 | Russell | |
| D210,935 S | | 5/1968 | Cook | |
| 3,655,112 A | * | 4/1972 | Jeffers | B65D 81/056 206/320 |

(Continued)

FOREIGN PATENT DOCUMENTS

| | | |
|---|---|---|
| CA | 2812108 | 6/2013 |
| WO | 2014108927 | 7/2014 |
| WO | 2014116668 | 7/2014 |

*Primary Examiner* — Adriana Figueroa
*Assistant Examiner* — Jessie T Fonseca
(74) *Attorney, Agent, or Firm* — Bereskin & Parr LLP

(57) ABSTRACT

Disclosed herein is a panel system for covering a building wall. The panel system includes at least one panel assembly. Each panel assembly includes a panel having a front panel wall, a side panel wall, and a back mounting flange overhanging the front panel wall. Each panel also includes at least one perimeter extrusion. Each perimeter extrusion includes a panel engaging portion having a panel slot shaped to receive the back mounting flange of the panel, and a connector engaging portion having a connector slot. The panel system also includes at least one connector extrusion for mounting the panel assembly to the building wall. Each connector extrusion includes a connector base mountable to the building wall, and at least one connector flange shaped to fit in the connector slot of the perimeter extrusion.

12 Claims, 20 Drawing Sheets

(56) References Cited

U.S. PATENT DOCUMENTS

| | | | | |
|---|---|---|---|---|
| D255,940 | S | 7/1980 | Kwan et al. | |
| D258,262 | S | 2/1981 | Sharon | |
| 4,344,267 | A * | 8/1982 | Sukolics | 52/475.1 |
| D286,187 | S | 10/1986 | Bancroft | |
| D286,190 | S | 10/1986 | Bancroft | |
| D296,187 | S | 6/1988 | Mischenko | |
| D299,273 | S | 1/1989 | Pittman, Jr. | |
| 4,829,740 | A | 5/1989 | Hutchison | |
| D320,094 | S | 9/1991 | Miller et al. | |
| 5,226,274 | A | 7/1993 | Sommerstein | |
| D353,128 | S | 12/1994 | Christensen | |
| 5,384,998 | A | 1/1995 | Tanaka et al. | |
| 6,035,598 | A | 3/2000 | Sukolics et al. | |
| D433,459 | S | 11/2000 | Balchin | |
| 6,330,772 | B1 | 12/2001 | Mitchell et al. | |
| 6,442,907 | B1 * | 9/2002 | Doyon | E04F 13/081 52/204.5 |
| D491,281 | S | 6/2004 | Barnett | |
| 6,745,527 | B1 * | 6/2004 | Sherman et al. | 52/235 |
| 6,748,709 | B1 * | 6/2004 | Sherman et al. | 52/235 |
| D583,221 | S | 12/2008 | Johnsen | |
| D585,267 | S | 1/2009 | Di Vinadio | |
| 7,472,521 | B2 | 1/2009 | Bilge | |
| 7,621,084 | B2 | 11/2009 | Bilge | |
| 7,716,891 | B2 * | 5/2010 | Radford | 52/506.08 |
| D625,588 | S | 10/2010 | Norris et al. | |
| D626,663 | S | 11/2010 | Stephens | |
| 7,937,902 | B1 * | 5/2011 | Smith et al. | 52/235 |
| D640,593 | S | 6/2011 | Wanibuchi et al. | |
| 8,127,507 | B1 | 3/2012 | Bilge | |
| 8,240,099 | B2 | 8/2012 | Hummel, III | |
| 8,584,601 | B1 | 11/2013 | Deschner | |
| 8,739,483 | B1 | 1/2014 | Bilge | |
| 8,640,402 | B1 | 2/2014 | Bilge | |
| 8,745,941 | B2 | 6/2014 | Macdonald et al. | |
| 8,833,015 | B2 | 9/2014 | Bilge | |
| 8,925,271 | B1 | 1/2015 | Bilge | |
| 8,966,849 | B1 | 3/2015 | Bilge | |
| 9,068,353 | B1 | 6/2015 | Kovalchuk | |
| 9,091,079 | B2 | 7/2015 | Wright | |
| D742,548 | S | 11/2015 | Singh | |
| D744,667 | S | 12/2015 | MacDonald et al. | |
| D745,192 | S | 12/2015 | Suciu et al. | |
| 2005/0034386 | A1 * | 2/2005 | Crandell et al. | 52/204.5 |
| 2007/0022682 | A1 | 2/2007 | Morgenegg et al. | |
| 2007/0119105 | A1 | 5/2007 | MacDonald et al. | |
| 2008/0134594 | A1 * | 6/2008 | Ness | 52/200 |
| 2008/0155917 | A1 * | 7/2008 | Bilge | 52/235 |
| 2009/0241444 | A1 | 10/2009 | Griffiths | |
| 2009/0241451 | A1 | 10/2009 | Griffiths | |
| 2010/0037549 | A1 | 2/2010 | Lynch et al. | |
| 2010/0263314 | A1 | 10/2010 | MacDonald et al. | |
| 2012/0017530 | A1 | 1/2012 | Hummel, III | |
| 2012/0096799 | A1 | 4/2012 | Wright | |
| 2012/0198788 | A1 * | 8/2012 | MacDonald et al. | 52/747.1 |
| 2014/0202112 | A1 | 7/2014 | Bilge | |
| 2014/0202113 | A1 | 7/2014 | Bilge | |
| 2014/0223850 | A1 | 8/2014 | Bilge | |
| 2015/0121794 | A1 | 5/2015 | Koetje | |
| 2015/0345152 | A1 | 12/2015 | Libreiro et al. | |

* cited by examiner

PANEL SYSTEM FOR COVERING A BUILDING WALL

TECHNICAL FIELD

The embodiments disclosed herein relate generally to panel systems for covering building walls, and in particular, to panel systems that include extrusions for mounting panels to building walls.

INTRODUCTION

The following paragraphs are not an admission that anything discussed in them is prior art or part of the knowledge of persons skilled in the art.

U.S. Pat. No. 8,240,099 discloses an architectural panel system including a plurality of architectural panels, a first mounting extrusion attached to a first architectural panel, and a second mounting extrusion attached to a second architectural panel, as well as a first anchor clip including a first attachment configuration that enables the first mounting extrusion to be slidably attached thereto, and a second anchor clip including a second attachment configuration that enables the second mounting extrusion to be slidably attached thereto. The system also includes a panel joint filler strip. The first mounting extrusion includes a first pocket portion, and the second mounting extrusion includes a second pocket portion that is shallower than the first pocket portion. The first and second pocket portions cooperate with each other to seat the panel joint filler strip. Also disclosed are methods of installing the panel system and of replacing a damaged panel of an installed array of panels.

U.S. Patent Application 2009/0241451 discloses a wall panel system including a mounting bracket, a wall panel, and a clip attached to the wall panel. The clip has an engaging element that secures it to the mounting bracket. The wall panel system also includes a slot in the clip facing outwardly from the wall panel, a spline slidably positioned in the slot of the clip, and a sealing insert positioned between the mounting bracket and the spline. The sealing insert may be in the shape of an X, and may be made from polypropylene foam. The sealing insert may also have a gasket tape on one side to provide an improved seal.

U.S. Patent Application 2012/0096799 discloses a mounting apparatus for mounting a panel to a structure. The mounting apparatus includes a panel extrusion that attaches to a back side of the panel such that the panel extrusion is obscured behind the panel in order to show a clean surface look. A connector extrusion secures the panel extrusion to the structure for simple construction.

SUMMARY

In a first aspect, a panel system for covering a building wall is provided. The panel system may comprise at least one panel assembly and at least one connector extrusion. Each panel assembly may include a panel, at least one perimeter extrusion, and a filler strip. The panel may include a front panel wall, a side panel wall, and a first back mounting flange. The perimeter extrusion may include a panel engaging portion having a panel slot, a connector engaging portion having a connector slot, and an intermediate recess formed between the panel and connector engaging portions. The first back mounting flange may be received in the panel slot. The filler strip may be received in the intermediate recess abutting the first back mounting flange and the connector engaging portion. The connector extrusion may include a connector base mountable to the building wall, and at least one connector flange received in the connector slot of the perimeter extrusion.

In another aspect, a building panel for covering a building wall is provided. The building panel may comprise a front panel wall, a plurality of side panel walls extending along a perimeter of the front panel wall. and a plurality of back mounting flanges. Each back mounting flange may extend from a respective side panel wall of the plurality of side panel walls. Each back mounting flange may overhang the front panel wall. Each back mounting flange may extend in length from a first flange end to a second flange end. The plurality of back mounting flanges may include at least a first back mounting flange and a second back mounting flange. The first flange end of the first back mounting flange may include a flange protrusion received in a flange recess of the second flange end of the second back mounting flange.

In another aspect, a panel system for covering a building wall is provided. The panel system may comprise at least one panel assembly, and at least one connector extrusion. Each panel assembly may include a panel and at least one perimeter extrusion. Each perimeter extrusion may include a panel engaging portion connected to the panel, and a connector engaging portion having a connector slot. Each connector extrusion may include a connector base mountable to the building wall, at least one connector flange received in the connector slot of the perimeter extrusion, and a retaining arm inhibiting lateral withdrawal of the connector flange from the connector slot.

In another aspect, a method of forming a panel is provided. The method may comprise providing a flat panel blank having a front panel wall and a plurality of peripheral panel portions extending along a periphery of the panel blank. The front panel wall and the peripheral panel portions may bee coplanar. Each peripheral panel portion may include a side panel wall inboard of a back mounting flange. Each back mounting flange may extend in length from a first flange end to a second flange end. Each of the first and second flange ends of each back mounting flange may include at least one of a flange protrusion and a flange recess. The method may further comprise for each peripheral panel portion, folding the back mounting flange relative to the side panel wall, and folding the side panel wall relative to the front panel wall to form a U-shaped channel. The method may further comprise engaging the flange protrusions and flange recesses of adjacent flange ends of adjacent back mounting flanges.

In another aspect, a method of making a panel assembly is provided. The method may comprise providing a panel having a front panel wall, a side panel wall, and a back mounting flange; providing a perimeter extrusion comprising a panel engaging portion having a panel slot, a connector engaging portion having a connector slot, and an intermediate recess formed between the panel and connector engaging portions; receiving the back mounting flange in the panel slot; and receiving a filler strip in the intermediate recess abutting the back mounting flange and the connector engaging portion.

BRIEF DESCRIPTION OF THE DRAWINGS

The drawings included herewith are for illustrating various examples of articles, methods, and apparatuses of the present specification. In the drawings.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed below that is not claimed in this document may be the subject matter of another protective instrument, for example, a continuing patent application, and the applicants, inventors or owners do not intend to abandon, disclaim or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. As used herein, two or more parts are said to be "rigidly coupled", "rigidly connected", "rigidly attached", or "rigidly fastened" where the parts are coupled so as to move as one while maintaining a constant orientation relative to each other. None of the terms "coupled", "connected", "attached", and "fastened" distinguish the manner in which two or more parts are joined together.

As used herein and in the claims, a first part (e.g. a flange) is said to be "received" in or by a second part (e.g. a slot) where the first part is either partially or wholly received in or by the second part, unless specifically described as being "partially received" or "wholly received" in or by the second part.

Figure 1:
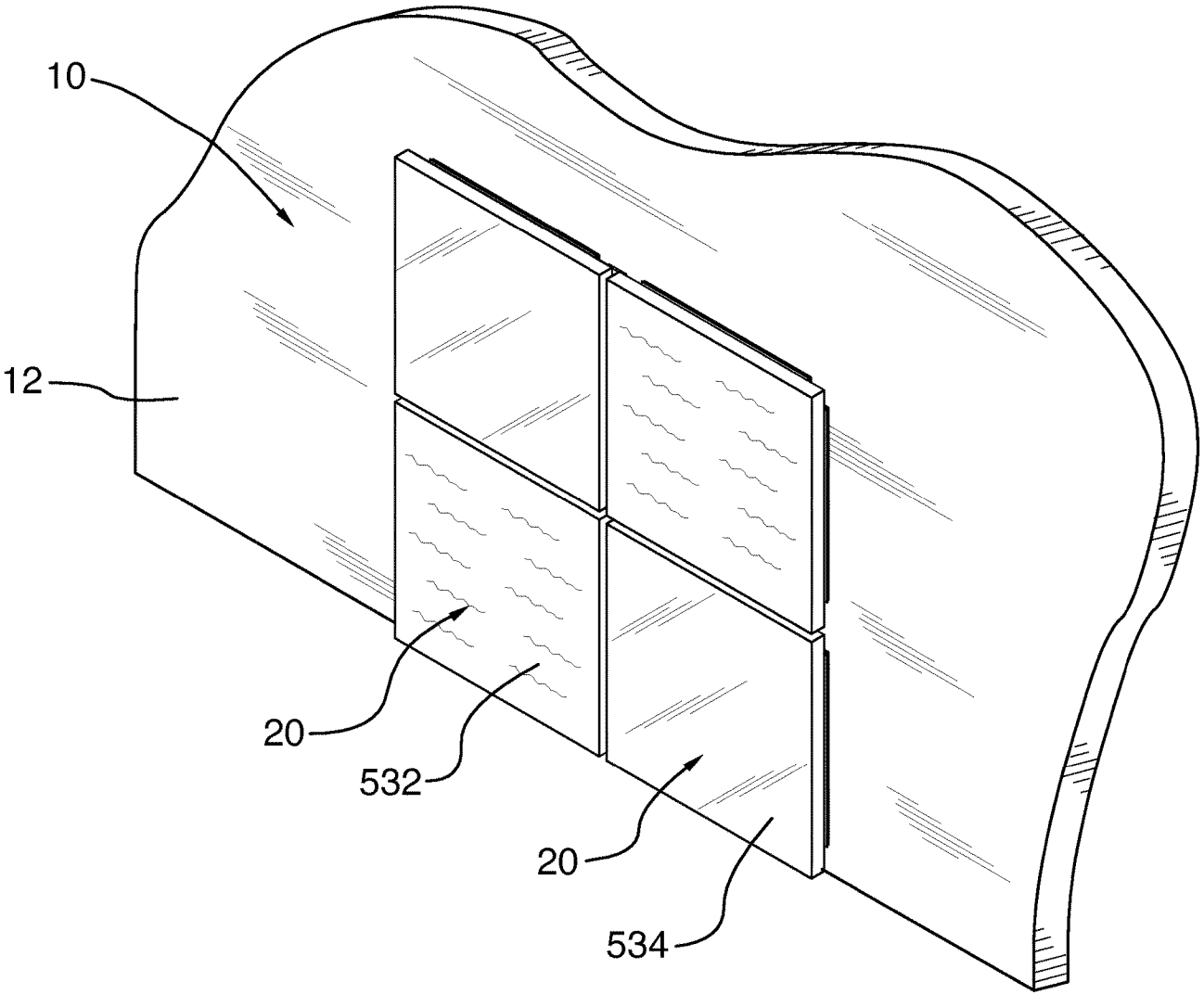
FIG. 1 is a perspective view of a panel system for covering a building wall.
Figure 2:
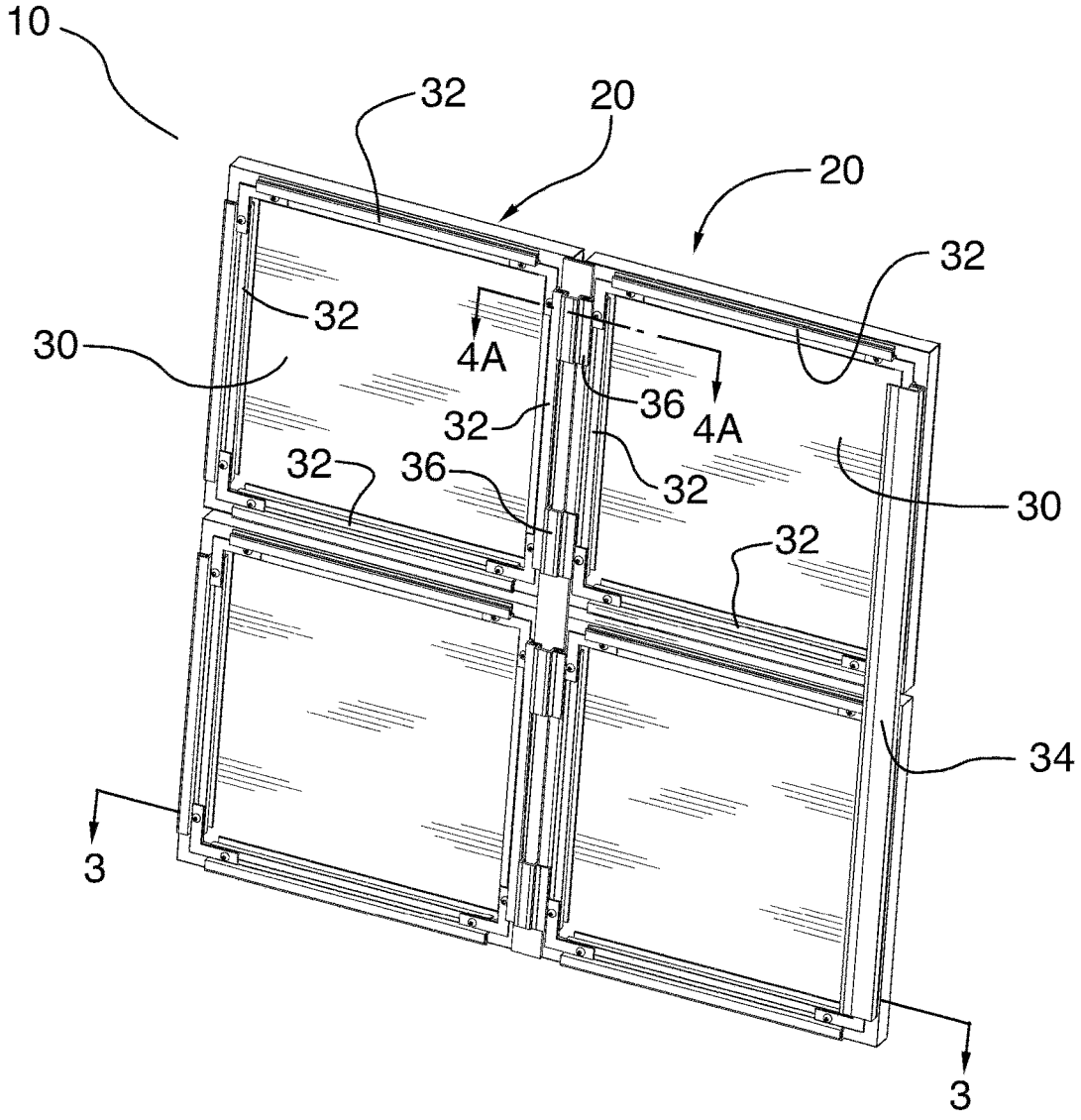
FIG. 2 is a rear perspective view of the panel system of FIG. 1.

Referring to FIGS. 1 and 2, there is a panel system 10 for covering a building wall 12 such as an exterior wall of a commercial or residential building. The panel system 10 includes one or more panel assemblies 20. As shown in FIG. 2, each panel assembly 20 includes a panel 30 and one or more perimeter extrusions 32 that engage the panel 30.

Figure 3:
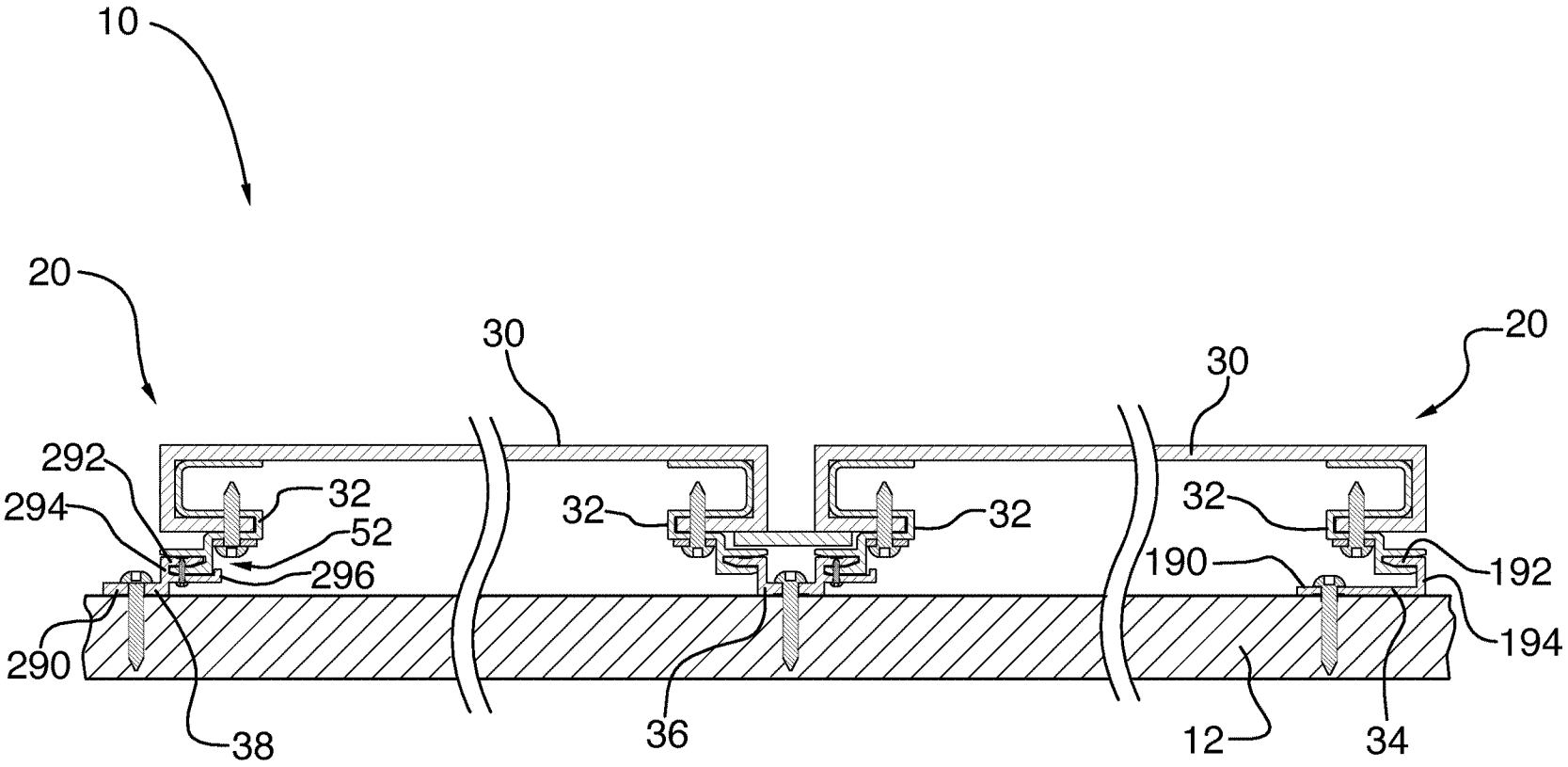
FIG. 3 is a cross-sectional view of the panel system of FIG. 2 along line 3-3 showing a starter trip, mid-clip and half-clip for mounting panel assemblies to the building wall.

Referring now to FIGS. 2 and 3, the panel assemblies 20 are mounted to the building wall 12 using one or more connector extrusions that engage the perimeter extrusions 32 of the panel assemblies 20. For example, the connector extrusions may include a starter strip 34, a mid-clip 36, a half-clip 38 (shown in FIG. 3), or combinations of one or more thereof. As will be described below, the starter strip 34 may be used as a starting point for mounting the panel assemblies 20 to the building wall 12. The mid-clip 36 may be used as a joint for mounting two adjacent panel assemblies 20 to the building wall 12. The half-clip 38 may be used as an end point for completing installation of the panel system 10.

Figure 4A:
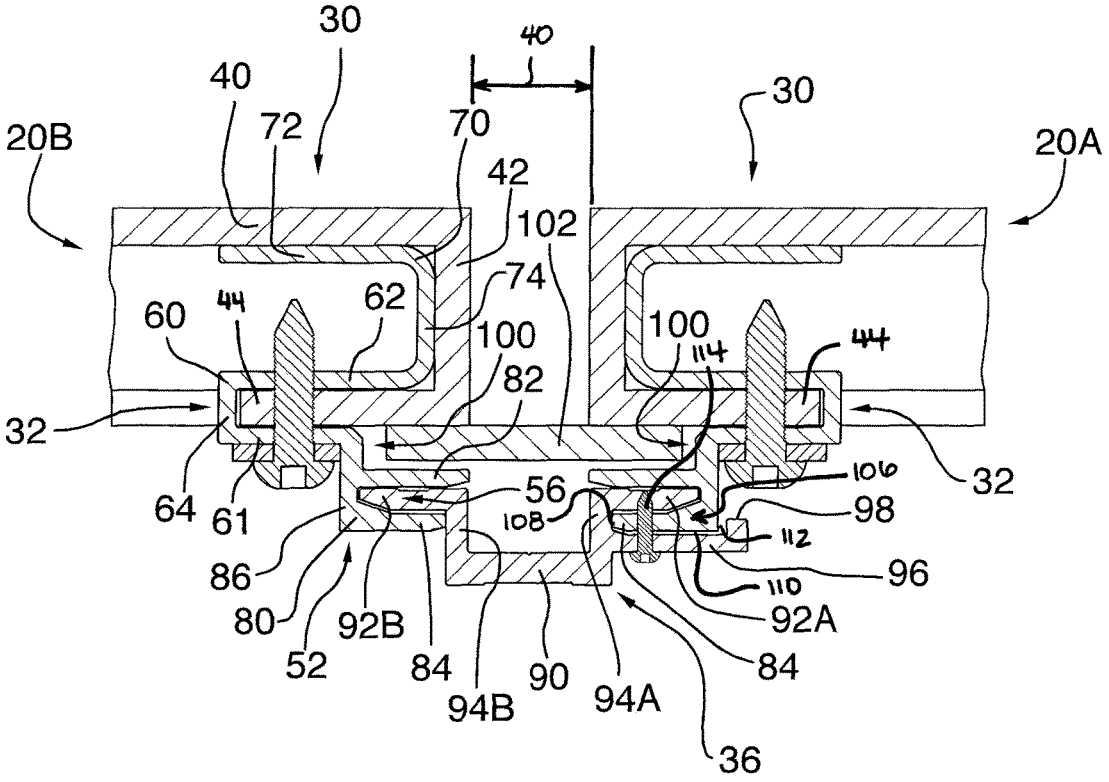
FIG. 4A is a cross-sectional view of the panel system of FIG. 2 along line 4A-4A showing a mid-clip for mounting two panel assemblies to the building wall.
Figure 4B:
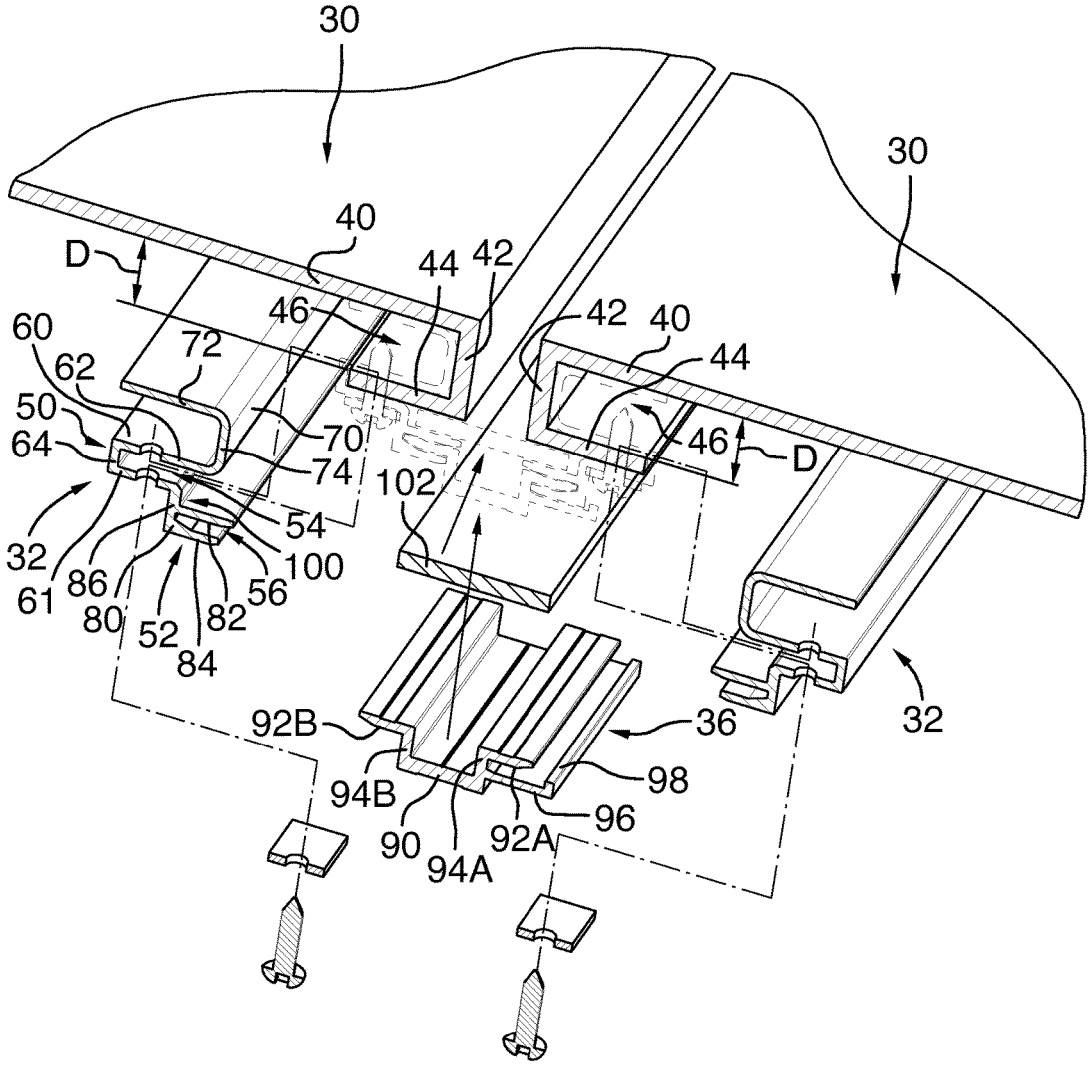
FIG. 4B is an exploded cross-sectional perspective view of the panel system of FIG. 4A.

Referring now to FIGS. 4A and 4B, each panel 30 includes a front panel wall 40, a side panel wall 42, and a back mounting flange 44 overhanging the front panel wall 40. The side panel wall 42 and back mounting flange 44 may be located along each edge of the front panel wall 40.

As shown, the side panel wall 42 may extend orthogonally from the front panel wall 40, and the back mounting flange 44 may extend orthogonally from the side panel wall 42 to overhang the front panel wall 40. The front panel wall 40 and the back mounting flange 44 may be spaced apart by a distance D, which may form an overhang slot 46 therein (shown in FIG. 4B).

In some panel mounting systems, rivets may be inserted through and connect the side walls of the panels to their perimeter extrusions. Accordingly, a hole is formed through the panel side walls into which the rivets are inserted. This may affect the weather tightness of the panel sidewalls against water and dirt penetration. Further, exposed rivet heads may be visible along the panel side walls to the detriment of the panel aesthetics. In some cases, the exposed rivet heads may rust and bleed rust residue down the panels. The panel assemblies disclosed herein may have perimeter extrusions connected to panels without rivets or other fasteners penetrating the panel sidewalls.

Referring to FIGS. 4A and 4B, each perimeter extrusion 32 includes a panel engaging portion 50 for engaging the panel 30, and a connector engaging portion 52 for engaging one of the connector extrusions 34, 36, or 38. The panel engaging portion 50 may have a panel slot 54 (shown in FIG.

4B) shaped to receive the back mounting flange 44 of the panel 30. The connector engaging portion 52 may have a connector slot 56 shaped to engage one of the connector extrusions 34, 36, or 38. For example, the connector slot 56 of each perimeter extrusion 32 may be shaped to receive a connector flange 92B of one of the mid-clip 36 (as will be described below).

As shown, the panel engaging portion 50 may include a first U-shaped panel engaging portion 60, which may define the panel slot 54 for receiving the back mounting flange 44 of the panel 30. The first U-shaped panel engaging portion 60 may be defined by two opposed intermediate walls 61, 62 that are interconnected by an intermediate extension 64.

The panel engaging portion 50 may also include a second U-shaped panel engaging portion 70 for engaging the panel 30. In particular, the second U-shaped panel engaging portion 70 may engage the overhang slot 46. For example, the second U-shaped panel engaging portion 70 may abut an interior panel surface that extends along the back mounting flange 44, the side panel wall 42, and the front panel wall 40 of the panel 30.

The second U-shaped panel engaging portion 70 may be joined to the first U-shaped panel engaging portion 60. For example, the second U-shaped panel engaging portion 70 may be defined by the intermediate wall 62 and an opposing panel-side outer wall 72 that are interconnected by a panel-side extension 74. As shown, the second U-shaped panel engaging portion 70 may face opposite to the first U-shaped panel engaging portion 60 (e.g. to form an S-shaped profile).

The connector engaging portion 52 may include a U-shaped connector engaging portion 80 defining the connector slot 56. The U-shaped connector engaging portion 80 may be defined an intermediate flange 82 and an opposing connector-side outer wall 84 that are interconnected by a connector-side extension 86.

The connector engaging portion 52 may be joined to the panel engaging portion 50 (e.g. via an integral joint between the connector-side extension 86 and the intermediate wall 61).

Figure 9:
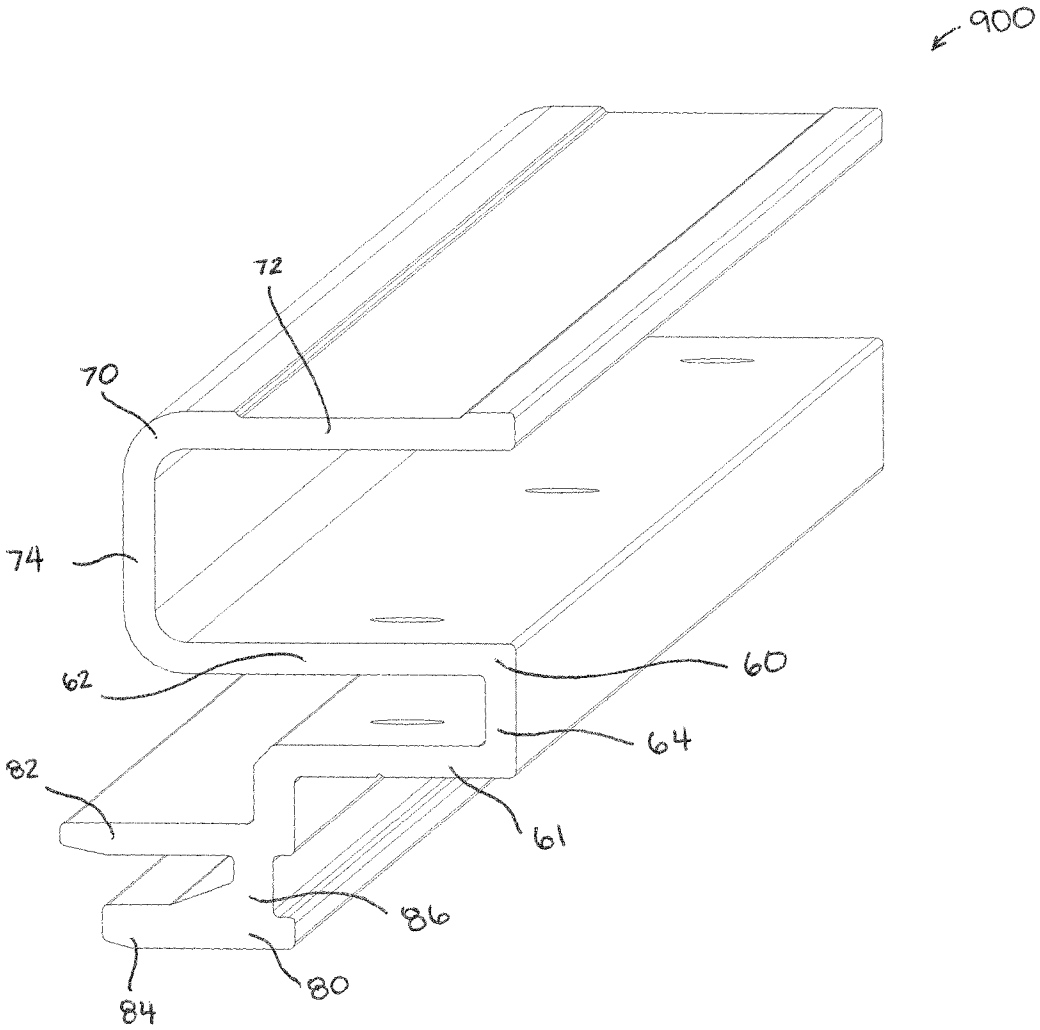
FIG. 9 is a perspective view of a perimeter extrusion in accordance with another embodiment.

FIG. 9 shows a perimeter extrusion 900 in accordance with another embodiment, where like part numbers refer to like parts in the previous figures.

Referring now to FIGS. 4A and 4B, each connector extrusion (such as the mid-clip 36) includes a connector base 90 mountable to the building wall 12. The connector base 90 may be a planar wall.

Each connector extrusion (such as the mid-clip 36) also includes one or more connector flanges shaped to fit in the connector slot 56 of a corresponding perimeter extrusion 32. For example, in FIGS. 4A and 4B, the mid-clip 36 includes a first connector flange 92A extending away from the connector base 90 along a first direction for mounting a first panel assembly 20A to the building wall 12, and a second connector flange 92B extending away from the connector base 90 opposite to the first direction for mounting a second panel assembly 20B to the building wall 12. Each connector flange 92A, 92B may be joined to the connector base 90 via respective connector sidewalls 94A, 94B.

In some embodiments, the connector extrusion (e.g. the mid-clip 36) may include a connector retaining arm 96 for engaging the connector engaging portion 52 of the perimeter extrusion 32. As shown, the connector retaining arm 96 may extend laterally away from the first connector sidewall 94A (e.g. along the same direction as the first connector flange 92A). Furthermore, the connector retaining arm 94 may be located between the connector base 90 and the first connector flange 92A. As shown, the connector retaining arm 94 may have a lip 98 that engages (e.g. hooks onto) the connector-side outer wall 84 of the perimeter extrusion 32. This may permit connector retaining arm 96 to inhibit lateral withdrawal of the connector flange 92A from connector slot 56.

Referring to FIG. 4A, the connector extrusion (e.g. the mid-clip 36) may include a retention slot 106 sized and shaped to receive connector engaging portion 52. As shown, retention slot 106 may be defined by retaining arm 96 and connector flange 92A. Retention slot 106 may extend laterally from a closed inboard end 108 to an open outboard end 110. As illustrated, inboard end 108 may be defined by connector sidewall 94A from which connector flange 92A and retaining arm 96 may extend laterally outwardly. Retention slot 106 may receive connector-side outer wall 84 of connector engaging portion 52.

Lip 98 of retaining arm 94 may be positioned outboard of the outboard end 110 of retention slot 106. As shown, lip 98 may extend transverse to retention slot 106 toward connector flange 92A to obstruct withdrawal of connector-side outer wall 84 from retention slot 106. In some embodiments, when connector engaging portion 52 is received in retention slot 106 as shown, lip 98 may be laterally spaced apart from connector engaging portion 52 by a gap 112 to accommodate lateral thermal expansion.

Still referring to FIG. 4A, in some embodiments, a fastener 114 (e.g. a screw, rivet, or bolt) may be inserted across retention slot 106 (e.g. through retaining arm 96 and connector-side outer wall 84) for retaining connector-side outer wall 84 in retention slot 106. This may prevent connector extrusion 36 from sliding in the direction of extrusion (i.e. into the page of FIG. 4A) along perimeter extrusion 32. In alternative embodiments, fastener 114 may be omitted so that connector extrusion 36 is freely slidable along perimeter extrusion 32. In other words, connector engaging portion 52 may be freely movable along an extent of retention slot 106 (i.e. in the direction of extrusion). This may make installing panel assemblies 20A and 20B faster and more economical by saving the time, labor, and expense of adding fasteners 114.

Figure 11:
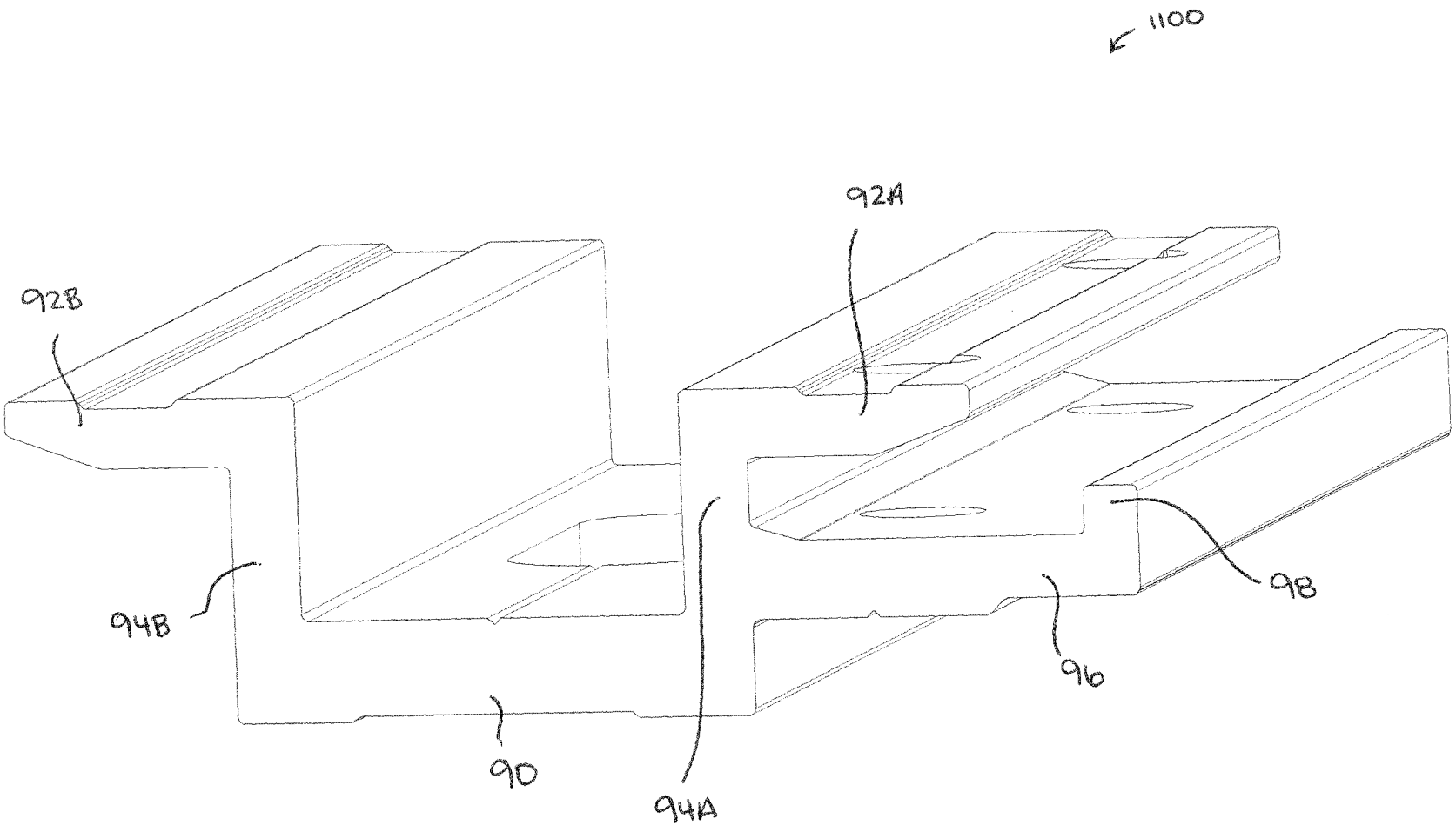
FIG. 11 is a perspective view of a mid clip in accordance with another embodiment.

FIG. 11 shows a perspective view of a mid clip 1100 in accordance with another embodiment, where like part numbers refer to like parts in the previous figures.

Referring back to FIG. 4A, each perimeter extrusion 32 may have an intermediate recess 100 located between the panel engaging portion 50 and the connector engaging portion 52. For example, the intermediate recess 100 may be defined as an instep along the connector-side extension 86 and the intermediate flange 82 (e.g. at a location generally opposite to the intermediate wall 61).

As shown in FIG. 4A, the intermediate recesses 100 of two adjacent perimeter extrusions 32 may cooperate to receive a filler strip 102 between the first panel assembly 20A and the second panel assembly 20B. The filler strip 102 might help conceal the mid-clip 36 after installation. Filler strip 102 may also help to seal the space between first and second panel assembly 20A and 20B against water, dirt, and/or debris. As shown, filler strip 102 may extend laterally across gap 104 between panels 30 of panel assemblies 20A and 20B and abut back mounting flanges 44 of each panel 30. This may provide an enlarged area of contact between filler strip 102 and panels 30 for an enhanced seal, compared to a filler strip that contacts only the raw edges of side panel walls 42.

Still referring to FIG. 4A, intermediate recess 100 may be provided by an enlarged spacing between intermediate wall 62 and connector engaging portion 52. When perimeter extrusion 32 is connected to a panel 30, intermediate recess 100 may be formed as a slot between connector engaging portion 52 and back mounting flange 44. As shown, intermediate recess 100 may be defined between intermediate flange 82 of connector engaging portion 52 and back mounting flange 44, whereby intermediate flange 82 may define the threshold between connector slot 56 and intermediate recess 100.

Referring again to FIG. 3, another example of a connector extrusion is the starter strip 34. The starter strip 34 includes a connector base 190, a connector flange 192, and a connector sidewall 194 between the connector base 190 and the connector flange 192. As shown, the connector flange 192 overhangs the connector base 190.

Referring still to FIG. 3, another example of a connector extrusion is the half-clip 38. The half-clip 38 includes a connector base 290 and a connector flange 292 that extends away from the connector base 290 along a first direction. As shown, the half-clip 38 may include a connector sidewall 294 between the connector base 290 and the connector flange 292.

In some embodiments, the half-clip 38 may include a connector retaining arm 296 for engaging the connector engaging portion 52 of a perimeter extrusion 32. The connector retaining arm 296 may extend away from the connector sidewall 294 along the same direction as the connector flange 292, and at a location between the connector base 290 and the connector flange 292.

Figure 10:
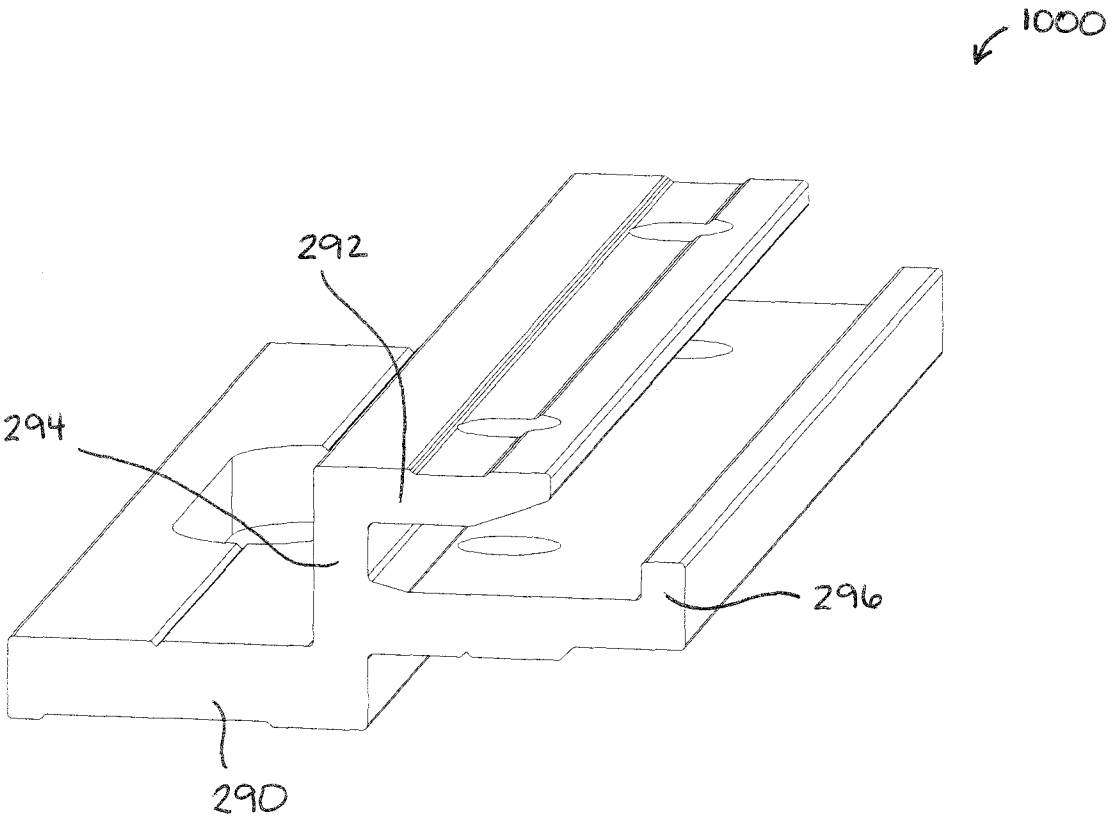
FIG. 10 is a perspective view of a half clip in accordance with another embodiment.

FIG. 10 shows a half clip 1000 in accordance with another embodiment, where like part numbers refer to like parts in the previous figures.

Figure 5A:
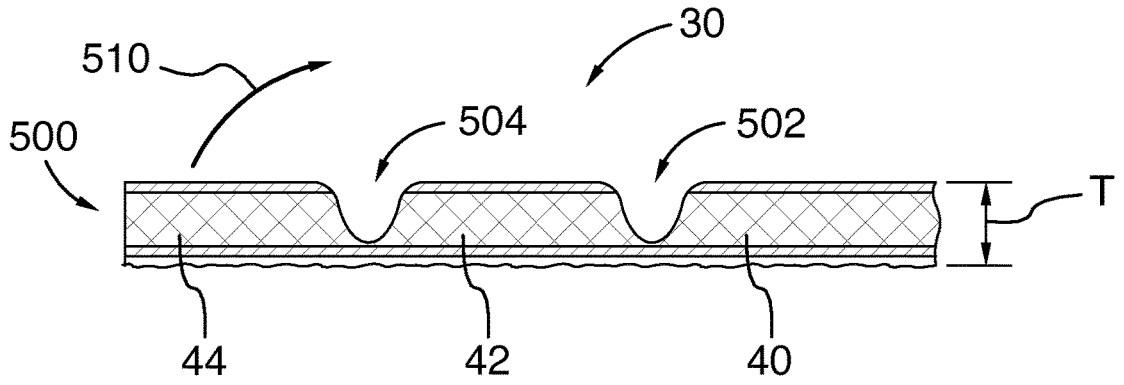
FIG. 5A is cross-sectional view of a sheet of material having V-shaped grooves that define fold lines for forming a panel.
Figure 5B:
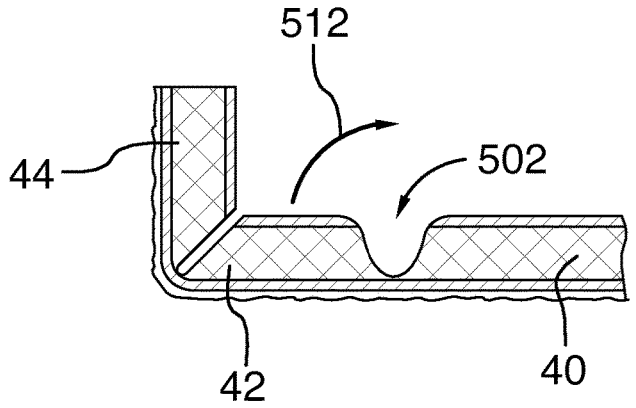
FIG. 5B is cross-sectional view of the sheet of material of FIG. 5A folded along a first fold line.
Figure 5C:
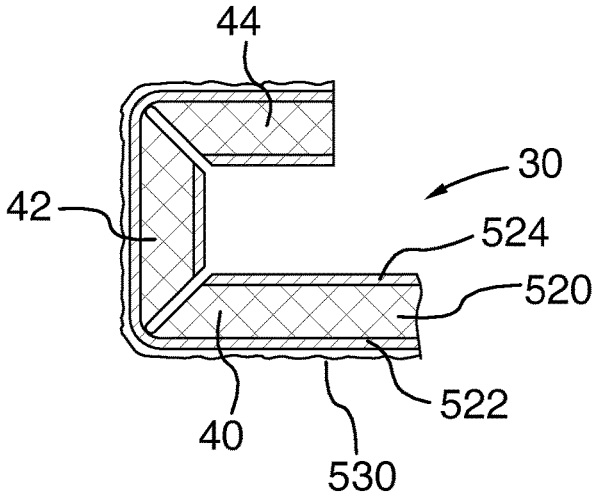
FIG. 5C is cross-sectional view of the sheet of material of FIG. 5B folded along a second fold line.

Referring now to FIGS. 5A, 5B and 5C, each panel 30 may be formed from a sheet of material 500 having a first fold line 502 between the front panel wall 40 and the side panel wall 42, and a second fold line 504 between the side panel wall 42 and the back mounting flange 44. As shown, the fold lines 502, 504 may be formed as generally V-shaped grooves along the sheet of material 500.

The panel 30 may be formed by bending the sheet of material 500 along the second fold line 504 in the direction of arrow 510 (as shown in FIG. 5A), and then by bending the sheet of material 500 along the first fold line 502 in the direction of arrow 512 (as shown in FIG. 5B).

Referring to FIG. 5C, the panel 30 may be an aluminum composite material having a core 520 located between two layers of aluminum 522, 524. The core 520 may be a plastic such as polyethylene or another material. In other embodiments, the panel 30 could be made from other materials such as solid aluminum.

In some embodiments, the panel 30 may have a front coating 530, which may cover exterior facing surfaces of panel 30 such as the front panel wall 40, the side panel wall 42, and the back mounting flange 44. The front coating 530 may be applied before or after folding the sheet of material 500 to form the panel 30.

In some embodiments, the front coating 530 may be paint, a laminate, an anodized layer, or another type of coating. For example, with reference to FIG. 1, the front coating may be applied as a textured coating 532 or a smooth coating 534.

Referring now to FIGS. 6A-6G, there is a method of covering a building wall with panels.

Figure 6A:
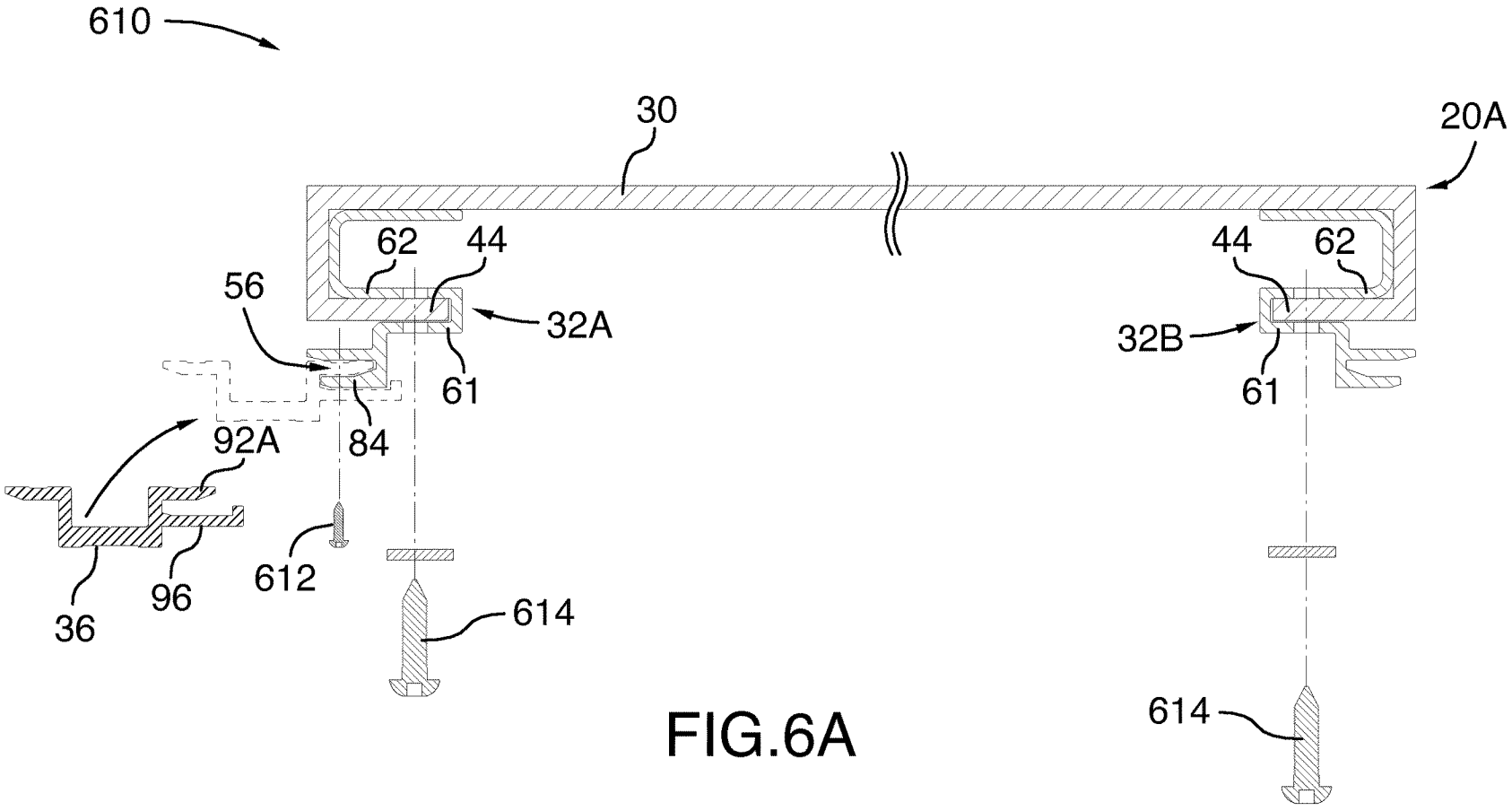
FIGS. 6A-6G are cross-sectional views showing a method of covering a building wall using panels.

With reference to FIG. 6A, the method may include step 610 of securing a first connector extrusion to a panel assembly. For example, this may include inserting the first connector flange 92A of a mid-clip 36 into the connector slot 56 of a first perimeter extrusion 32A on a first panel assembly 20A. The method may include securing the mid-clip 36 to the first panel assembly 20A using one or more fasteners 612 such as screws, rivets, or snap connectors. The fastener 612 may extend through the retaining arm 96 of the mid-clip 36, the connector-side outer wall 84 of the first perimeter extrusion 32A, and the first connector flange 92A of the mid-clip 36.

As shown in FIG. 6A, the method may also include assembling the first panel assembly 20A. For example, the method may include securing one or more perimeter extrusions 32A, 32B secured to the panel 30 using one or more fasteners 614 such as screws, rivets, or snap connectors. The fasteners 614 may extend through the intermediate walls 61, 62 of the perimeter extrusions 32A, 32B, and the back mounting flange 44 of the panel 30. In other embodiments, the first panel assembly 20A may be pre-assembled.

Figure 6B:
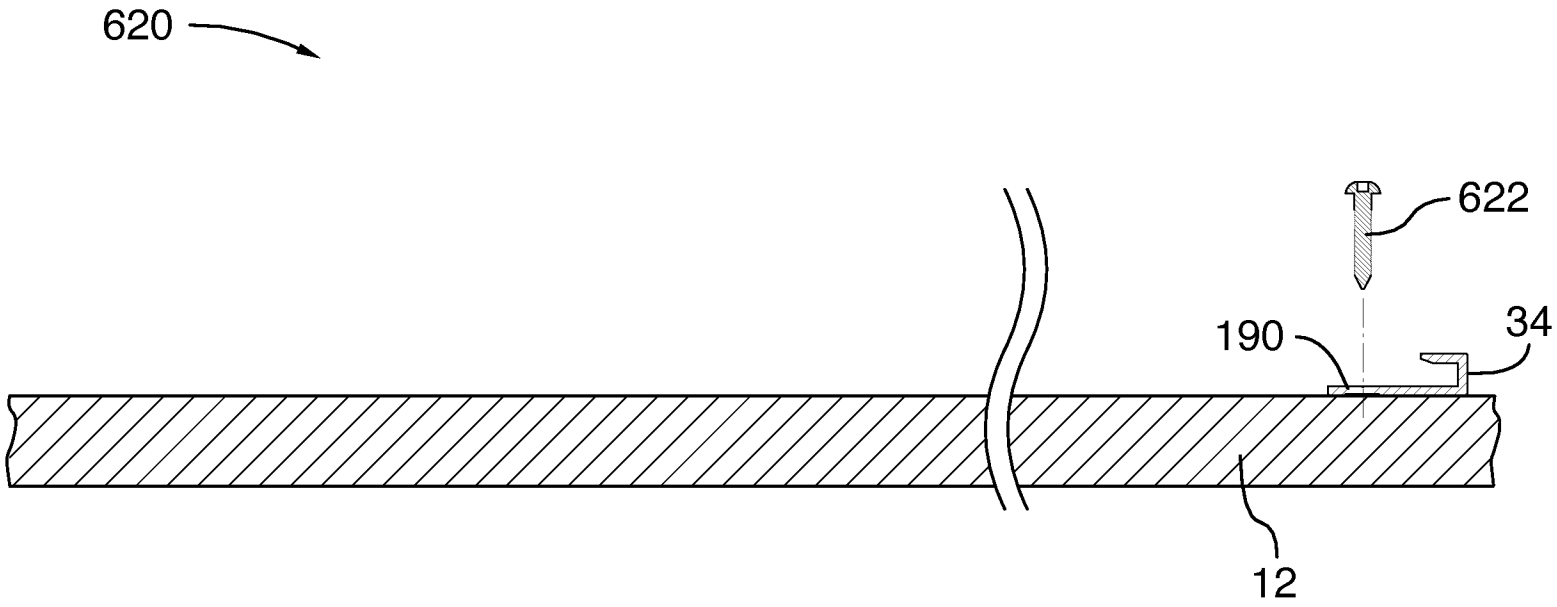

With reference to FIG. 6B, the method may include step 620 of fastening a second connector extrusion to the building wall. For example, this may include fastening the starter strip 34 to the building wall 12 using one or more fasteners 622 such as screws, bolts, or nails. The fasteners 622 may extend through the connector base 190 and into the building wall 12.

Figure 6C:
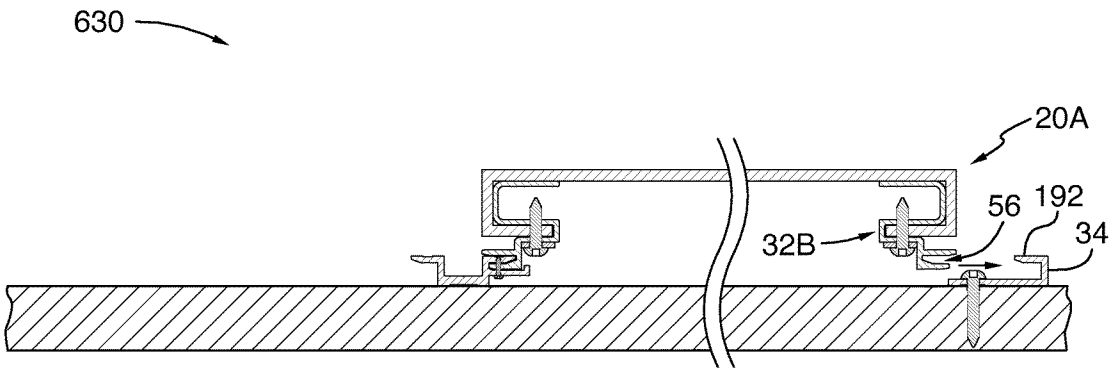

With reference to FIG. 6C, the method may include step 630 of mounting the panel assembly to the second connector extrusion that is mounted to the building wall. For example, this may include interconnecting the connector slot 56 of a second perimeter extrusion 32B with the connector flange 192 of the starter strip 34 (e.g. by sliding the first panel assembly 20A onto the starter strip 34).

Figure 6D:
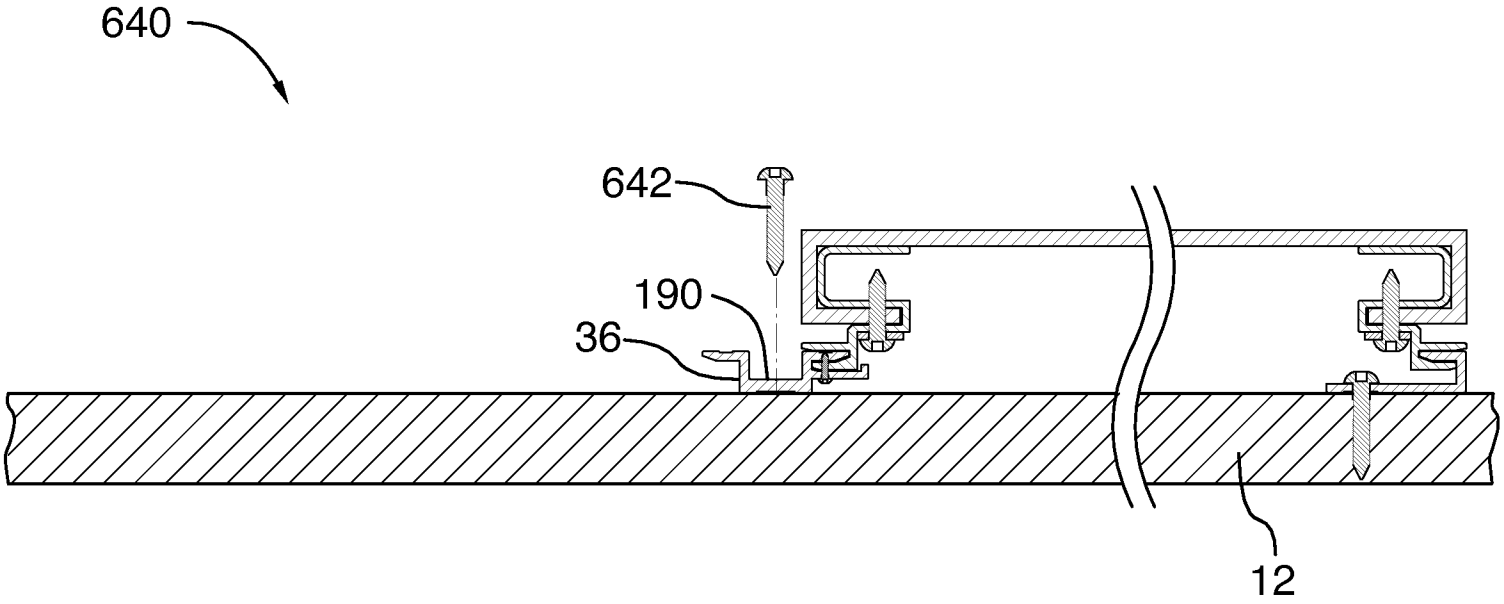

With reference to FIG. 6D, the method may include step 640 of fastening the first connector extrusion to the building wall. For example, this may include securing the mid-clip 36 to the building wall 12 using one or more fasteners 642 such as screws, bolts, or nails. The fasteners 642 may extend through the connector base 190 and into the building wall 12.

Figure 6E:
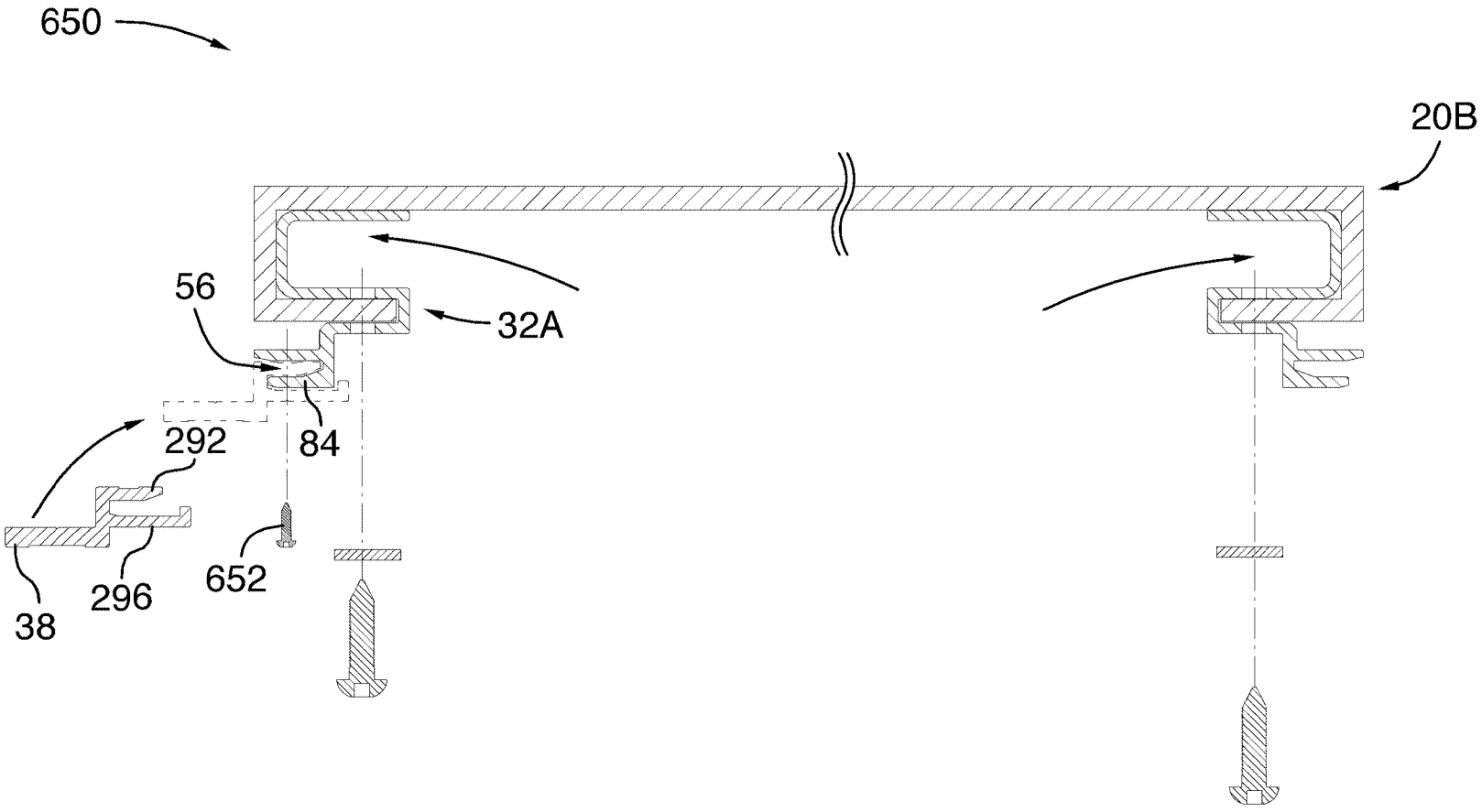

With reference to FIG. 6E, the method may include step 650 of securing a third connector extrusion to a second panel assembly. For example, this may include inserting the connector flange 292 of a half-clip 38 into the connector slot 56 of a first perimeter extrusion 32A on a second panel assembly 20B (which may be pre-assembled or unassembled). The method may include securing the half-clip 38 to the second panel assembly 20B using one or more fasteners 652 such as screws, rivets, or snap connectors. The fastener 652 may extend through the retaining arm 296 of the half-clip 38, the connector-side outer wall 84 of the first perimeter extrusion 32A, and the connector flange 292 of the half-clip 38.

Figure 6F:
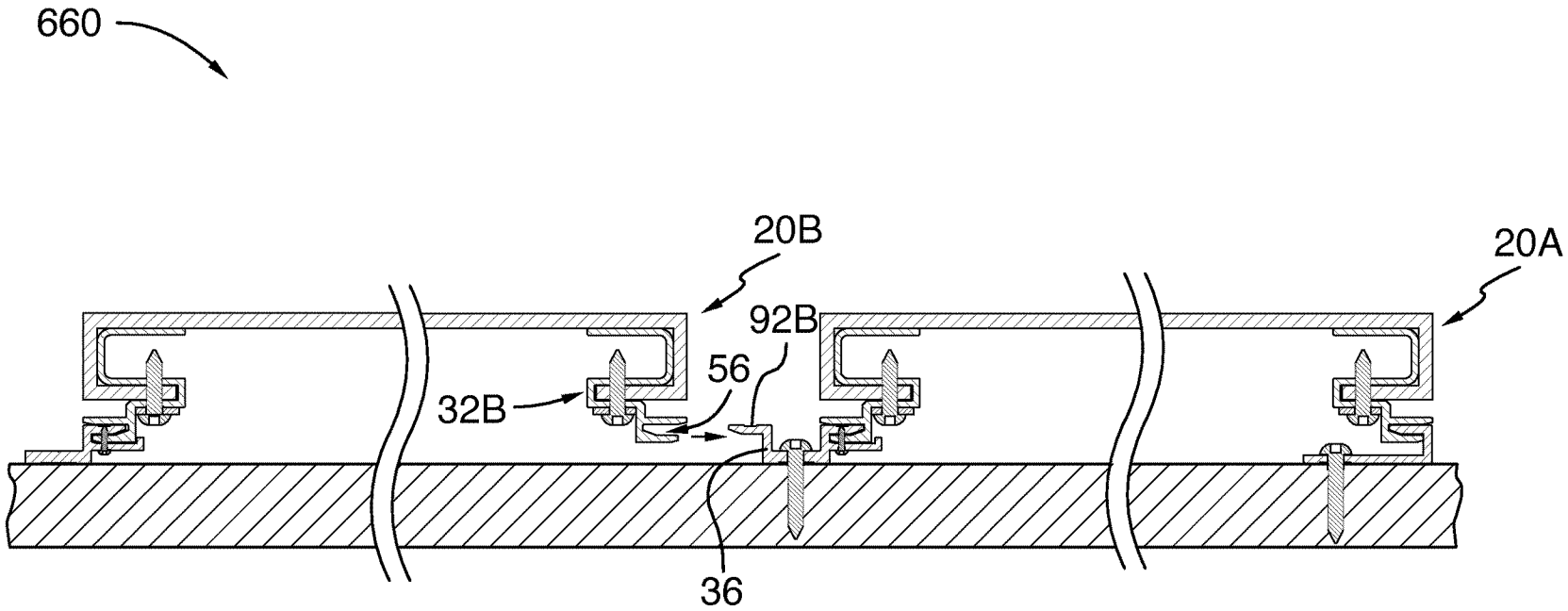

With reference to FIG. 6F, the method may include step 660 of mounting the second panel assembly to the first connector extrusion that is mounted to the building wall. For example, this may include interconnecting the connector slot 56 of a second perimeter extrusion 32B on the second panel assembly 20B with the second connector flange 92B of the mid-clip 36 (e.g. by sliding the second panel assembly 20B onto the mid-clip 36).

Figure 6G:
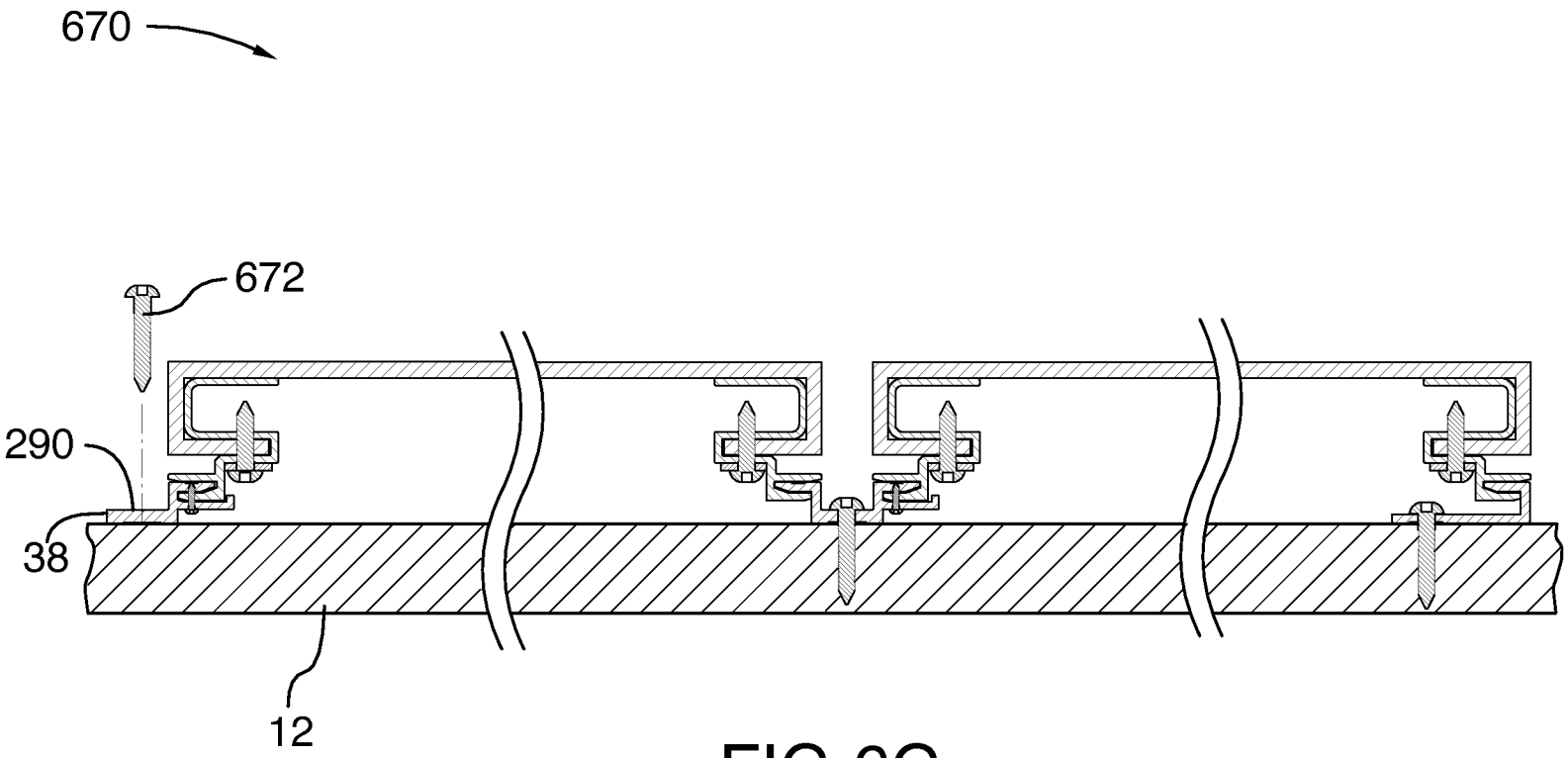

With reference to FIG. 6G, the method may include step 670 of fastening the third connector extrusion to the building wall. For example, this may include securing the half-clip 38 to the building wall 12 using one or more fasteners 672 such as screws, bolts, or nails. The fasteners 672 may extend through the connector base 290 and into the building wall 12.

In some embodiments, steps 650, 660, 670 may be completed a plurality of times using one or more mid-clips 36 instead of the half-clip 38. Generally, the last panel assembly is mounted to the building wall 12 using one or more half-clip 38. This may help provide a clean or finished look.

Figure 7:
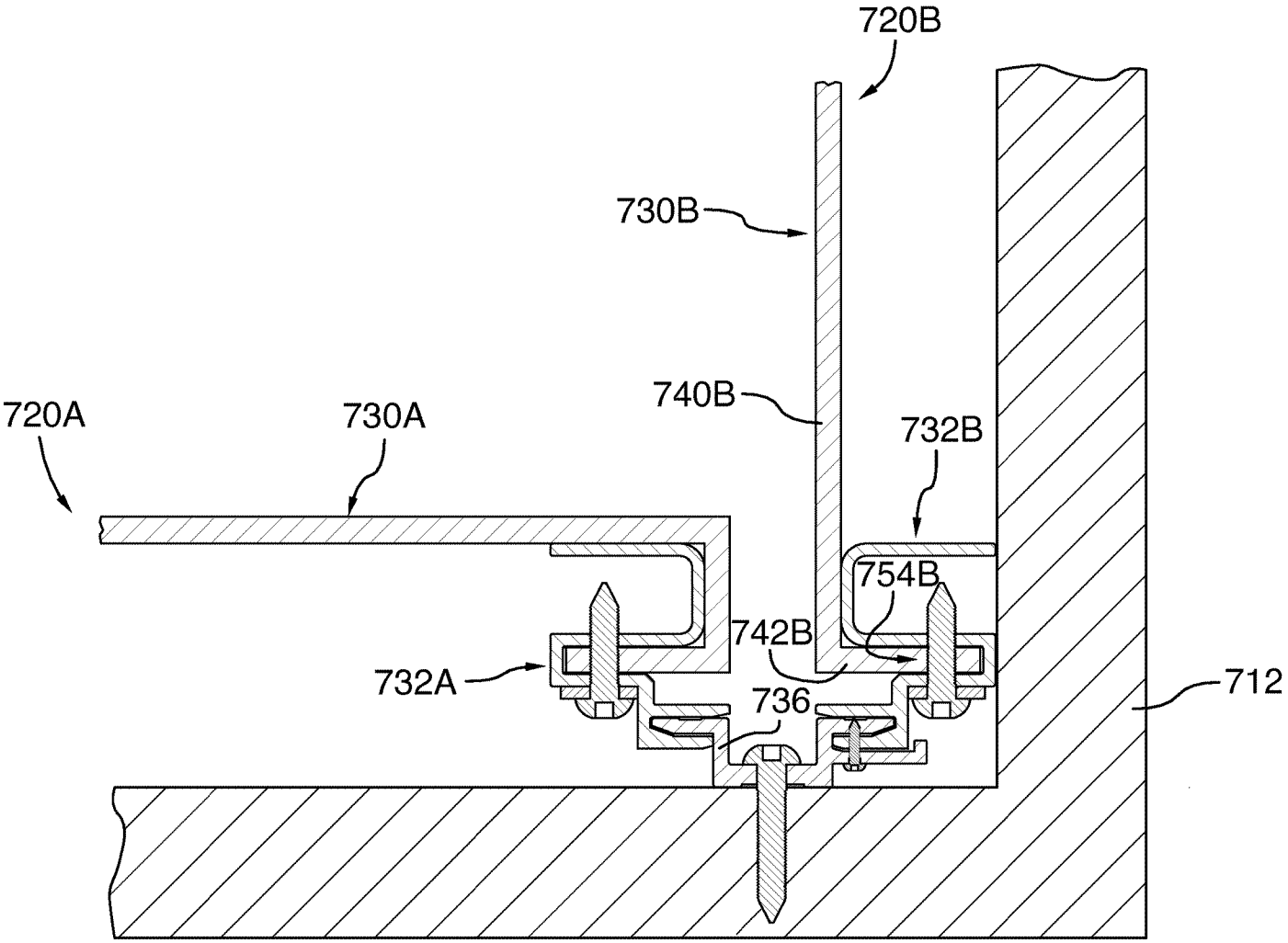
FIG. 7 is a cross-sectional view of a panel system for covering an inside corner of a building wall.

Referring now to FIG. 7, there is another panel system 710 for covering a building wall 712. The panel system 710 is similar in some respects to the panel system 10, and where appropriate, similar elements are given similar reference numerals incremented by seven hundred. For example, the panel system 710 includes two panel assemblies 720A, 720B mounted to the building wall 712 using one or more connector extrusions (e.g. a mid-clip 736). Furthermore, each panel assembly includes a panel 730A, 730B and one or more perimeter extrusions 732A, 732B.

In this example, the panel system 710 is installed on an inside corner of the building wall 712. Accordingly, the second panel assembly 720B may be oriented at an angle (e.g. orthogonal) to the first panel assembly 720A. This may result in a modified mounting configuration compared to the previous embodiments.

For example, while both panel assemblies 720A, 720B are mounted to the mid-clip 736, the second panel assembly 720B has a modified assembly. In particular, the panel 730B has a front panel wall 740B and a side panel wall 742B, and the perimeter extrusion 732B engages the side panel wall 742B (i.e. the side panel wall 742B is received in the panel slot 754B of the perimeter extrusion 720B).

While the one edge of the second panel assembly 720B that extends along the inside corner of building 712 may be configured in this way, the remaining edges of the second panel assembly 720B may be configured similar fashion to the previous embodiments. For example, the other edges of the second panel assembly 720B may include a back mounting flange, which may be received within a panel slot of a corresponding perimeter extrusion.

Figure 8A:
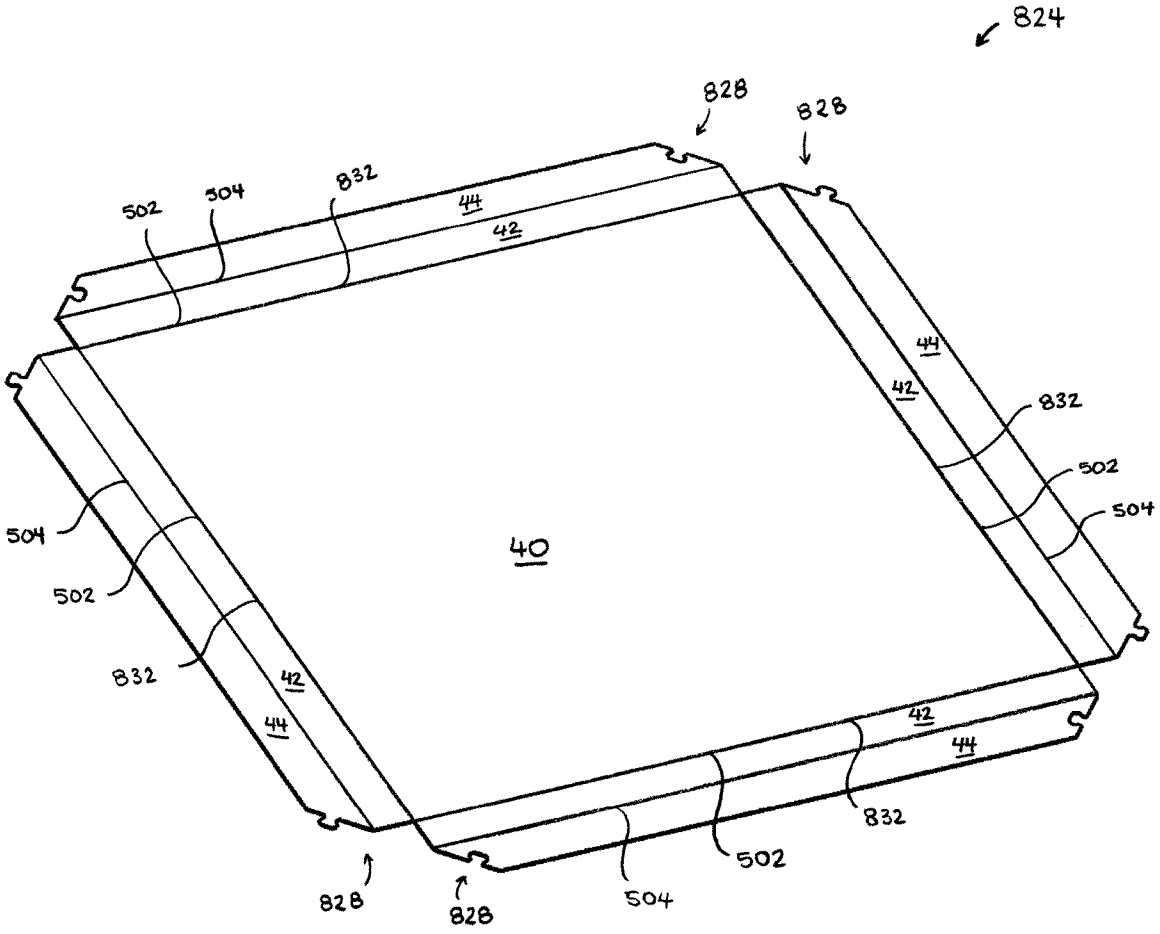
FIG. 8A is a perspective view of a panel blank in accordance with at least one embodiment.
Figure 8B:
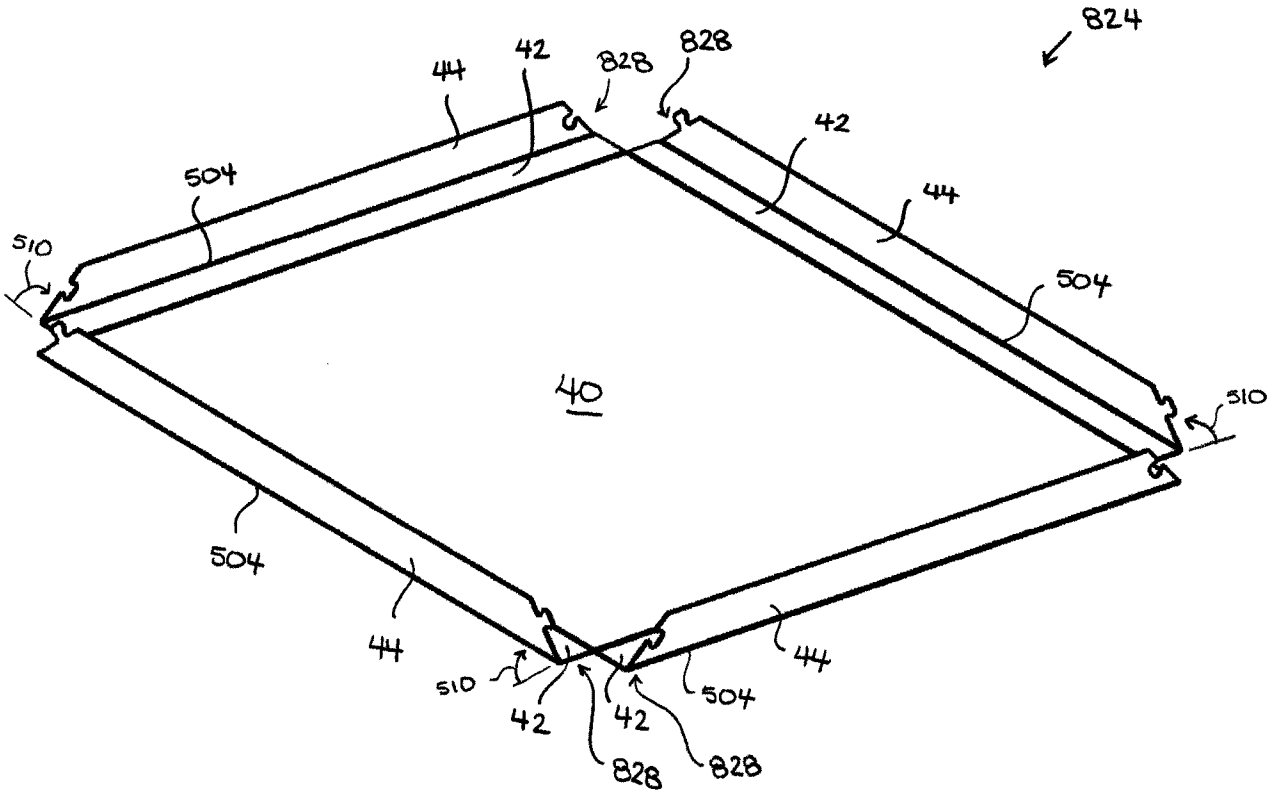
FIG. 8B is a perspective view of the panel blank of FIG. 8A with peripheral panel portions bent upwardly.
Figure 8C:
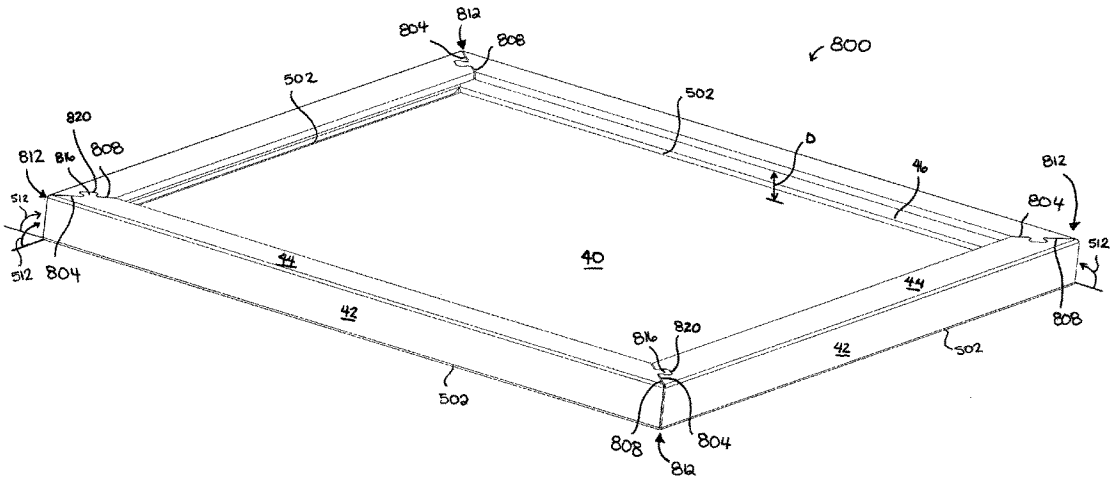
FIG. 8C is a perspective view a panel in accordance with another embodiment.

Reference is now made to FIG. 8C, where like part numbers refer to like parts in the previous figures, and where another embodiment of a panel 800 is shown. Panel 800 is similar to panel 30 in many respects, except for example the connecting corner features of panel 800.

As shown, adjacent back mounting flanges 44 of panel 800 may have mating features for joining those back mounting flanges 44 together. This may provide an enhanced connection between the back mounting flanges 44 against separation. For example, in a pair of adjacent back mounting flanges 44, at least one of the back mounting flanges 44 may include a recess sized to receive a corresponding protrusion of the other back mounting flange 44.

Still referring to FIG. 8C, each back mounting flange 44 extends in length from a first flange end 804 to a second flange end 808. In the illustrated embodiment, the first flange end 804 of one back mounting flange 44 abuts the second flange end 808 of another mounting flange 44 at each panel corner 812 of panel 800. At each panel corner 812, at least one of the flange ends 804 or 808 may include a flange protrusion 816 which is received in a mating flange recess 820 of the abutting flange end 804 or 808. In some embodiments, there may be one flange protrusion 816 and one flange recess 820 at each panel corner 812 as shown. In other embodiments there may be a plurality of flange protrusions 816 received in mating flange recesses 820 at one or more corners 812. In some embodiments, each panel corner 812 may include the same number of flange protrusions 816 and recesses 820, as shown. In other embodiments, one or more of panel corners 812 may include a different number of flange protrusions 816 and recesses 820 than one or more of the other panel corners 812.

Flange protrusions 816 and flange recesses 820 may have any suitable shapes. In the illustrated example, flange protrusions 816 have a round bulbous shape (like a puzzle piece), and flange recess 820 have a corresponding bulbous shape (like a puzzle piece). In other embodiments, flange protrusions 816 and flange recesses 820 may have any other suitable shape(s), such as square, triangular, or another regular or irregular shape. In the example shown, flange recesses 820 have the negative shape profile as the mating flange protrusion 816. In alternative embodiments, a flange recess 820 may have a different shaped compared to the mating flange protrusion 816.

FIGS. 8A-8C show steps in a method of forming panel 800 in accordance with at least one embodiment. Starting with FIG. 8A, a flat panel blank 824 may be formed including a front panel wall 40 and a plurality of peripheral panel portions 828 which extend along the panel blank periphery 832. Each peripheral panel portion 828 includes a side panel wall 42 inboard of a back mounting flange 44.

Flat panel blank 824 may be formed in any suitable fashion such as by machining, casting, or stamping for example. In some embodiments, fold lines 502 and 504 may be formed between front panel wall 40, side panel wall 42, and back mounting flange 44 as described above with respect to FIGS. 5A-5C. The front panel wall 40 and the peripheral panel portions 828 may be co-planar so that panel blank 824 is flat.

Turning now to FIG. 8B, each back mounting flange 44 may be rotated relative to the respective side panel wall 42 and front panel wall 40. For example, each back mounting flange 44 may be folded in direction 510 about fold line 504 to 90 degrees relative to the side panel wall 42 of the same peripheral panel portion 828.

Turning now to FIG. 8C, each side panel wall 42 may be rotated relative to front panel wall 40. For example, each side panel wall 42 may be folded in direction 512 about fold line 502 to 90 degrees relative to front panel wall 40. As shown, this may engage flange protrusions 816 with flange recesses 820 at panel corners 812. The back mounting flange 44, side panel wall 42 and front panel wall 40 form U-shaped channels.

While the above description provides examples of one or more apparatus, methods, or systems, it will be appreciated that other apparatus, methods, or systems may be within the scope of the claims as interpreted by one of skill in the art.

Items

Item 1. A panel system for covering a building wall, the panel system comprising:

a) at least one panel assembly, each panel assembly including:

i) a panel having a front panel wall, a side panel wall, and a first back mounting flange;

ii) at least one perimeter extrusion, each perimeter extrusion including a panel engaging portion having a panel slot, the first back mounting flange received in the panel slot, a connector engaging portion having a connector slot, and an intermediate recess formed between the panel and connector engaging portions; and iii) a filler strip received in the intermediate recess abutting the first back mounting flange and the connector engaging portion; and b) at least one connector extrusion, each connector extrusion including a connector base mountable to the building wall, and at least one connector flange received in the connector slot of the perimeter extrusion.

Item 2. The panel system of item 1, wherein the side panel wall extends orthogonally from the front panel wall and the first back mounting flange extends orthogonally from the side panel wall to overhang the front panel wall.

Item 3. The panel system of any one of items 1-2, wherein the panel engaging portion includes a first U-shaped panel engaging portion defining the panel slot.

Item 4. The panel system of any one of items 1-3, wherein the panel engaging portion includes a second U-shaped panel engaging portion engaging an interior panel surface that extends along the first back mounting flange, the side panel wall, and the front panel wall of the panel.

Item 5. The panel system of any one of items 1-4, wherein the connector engaging portion includes a U-shaped connector engaging portion defining the connector slot.

Item 6. The panel system of item 5, wherein the filler strip is received in the intermediate recess abutting the first back mounting flange and the U-shaped connector engaging portion that defines the connector slot.

Item 7. The panel system of item 5, wherein the U-shaped connector engaging portion comprises an intermediate flange defining a threshold between the connector slot and the intermediate recess.

Item 8. The panel system of any one of items 1-7, wherein the connector extrusion is a starter strip that includes a connector sidewall between the connector base and the connector flange, and wherein the connector flange overhangs the connector base.

Item 9. The panel system of any one of items 1-7, wherein:

the at least one panel assembly includes a second panel assembly, and the at least one connector flange includes a second connector flange received in the connector slot of the perimeter extrusion of the second panel assembly.

Item 10. The panel system of item 9, wherein for each of the connector flanges, the connector extrusion comprises a connector sidewall extending between the connector base and that connector flange.

Item 11. The panel system of any one of items 1-10, wherein:

the connector extrusion includes a connector retaining arm, the connector retaining arm and the connector flange defining a retention slot, and the connector engaging portion of the perimeter extrusion is received in the retention slot.

Item 12. The panel system of any one of items 1-11, wherein:

the panel further comprises a second back mounting flange, each back mounting flange extends in length from a first flange end to a second flange end, and the first flange end of the first back mounting flange includes a flange protrusion received in a flange recess of the second flange end of the second back mounting flange.

Item 13. A building panel for covering a building wall, the building panel comprising:

a front panel wall;

a plurality of side panel walls extending along a perimeter of the front panel wall; and a plurality of back mounting flanges, each back mounting flange extending from a respective side panel wall of the plurality of side panel walls, each back mounting flange overhanging the front panel wall, each back mounting flange extending in length from a first flange end to a second flange end, the plurality of back mounting flanges including at least a first back mounting flange and a second back mounting flange, and the first flange end of the first back mounting flange including a flange protrusion received in a flange recess of the second flange end of the second back mounting flange.

Item 14. The building panel of item 13, wherein each side panel wall extends orthogonally to the front panel wall.

Item 15. The building panel of any one of items 13-14, wherein each back mounting flange extends orthogonally to the respective side panel wall.

Item 16. The building panel of any one of items 13-15, wherein each flange end of each back mounting flange is adjacent the first or second flange end of another back mounting flange forming an adjacent pair of flange ends.

Item 17. The building panel of item 16, wherein in each adjacent pair of flange ends, a flange protrusion of one flange end is received in a flange recess of another flange end.

Item 18. The building panel of any one of items 13-15, wherein the flange protrusion is shaped to mate with the flange recess.

Item 19. The building panel of item 18, wherein a shape of the flange recess is the negative of a shape of the flange protrusion.

Item 20. A panel system for covering a building wall, the panel system comprising:

a) at least one panel assembly, each panel assembly including:

i) a panel; and ii) at least one perimeter extrusion, each perimeter extrusion including a panel engaging portion connected to the panel, and a connector engaging portion having a connector slot; and b) at least one connector extrusion, each connector extrusion including a connector base mountable to the building wall, at least one connector flange received in the connector slot of the perimeter extrusion, and a retaining arm inhibiting lateral withdrawal of the connector flange from the connector slot.

Item 21. The panel system of item 20, wherein:

the connector extrusion includes a retention slot defined by the retaining arm and the connector flange, and the connector engaging portion is received in the retention slot.

Item 22. The panel system of item 21, wherein:

the retention slot extends laterally from a closed inboard end to an open outboard end; and the retaining arm includes a lip positioned outboard of the outboard end of the retention slot and which extends transverse to the retention slot toward the connector flange.

Item 23. The panel system of item 22, wherein:

the connector includes a connector sidewall extending from the connector base, the connector flange and the retaining arm extend from the connector sidewall, and the connector sidewall defines the closed inboard end of the retention slot.

Item 24. The panel system of any one of items 22-23, wherein:

the lip is laterally spaced apart from the connector engaging portion of the perimeter extrusion.

Item 25. The panel system of any one of items 21-24, wherein:

connector engaging portion is freely movable along an extent of the retention slot.

Item 26. A method of forming a panel, the method comprising:

providing a flat panel blank having a front panel wall and a plurality of peripheral panel portions extending along a periphery of the panel blank, the front panel wall and the peripheral panel portions being coplanar, each peripheral panel portion including a side panel wall inboard of a back mounting flange, each back mounting flange extending in length from a first flange end to a second flange end, each of the first and second flange ends of each back mounting flange including at least one of a flange protrusion and a flange recess.

for each peripheral panel portion, folding the back mounting flange relative to the side panel wall, and folding the side panel wall relative to the front panel wall to form a U-shaped channel; and engaging the flange protrusions and flange recesses of adjacent flange ends of adjacent back mounting flanges.

Item 27. The method of item 26, wherein:

said folding the back mounting flange relative to the side panel wall comprises folding the back mounting flange to 90 degrees relative to the side panel wall.

Item 28. The method of any one of items 26-27, wherein:

said folding the side panel wall relative to the front panel wall comprises folding the side panel wall to 90 degrees relative to the front panel wall.

Item 29. The method of any one of items 26-28, further comprising:

for each peripheral panel portion, forming a first fold line between the side panel wall and the front panel wall.

Item 30. The method of item 29, wherein:

said folding the side panel wall relative to the front panel wall comprises folding the side panel wall along the first fold line.

Item 31. The method of any one of items 26-30, further comprising:

for each peripheral panel portion, forming a second fold line between the side panel wall and the back mounting flange.

Item 32. The method of item 31, wherein:

said folding the back mounting flange relative to the side panel wall comprises folding the back mounting flange along the second fold line.

Item 33. A method of making a panel assembly, the method comprising:

providing a panel having a front panel wall, a side panel wall, and a back mounting flange;

providing a perimeter extrusion comprising a panel engaging portion having a panel slot, a connector engaging portion having a connector slot, and an intermediate recess formed between the panel and connector engaging portions;

receiving the back mounting flange in the panel slot; and receiving a filler strip in the intermediate recess abutting the back mounting flange and the connector engaging portion.

Item 34. The method of item 33, wherein the side panel wall extends orthogonally from the front panel wall and the first back mounting flange extends orthogonally from the side panel wall to overhang the front panel wall.

Item 35. The method of any one of items 33-34, further comprising:

providing a connector extrusion having a connector base and at least one connector flange; and receiving the connector flange in the connector slot of the perimeter extrusion.

Item 36. The method of item 35, further comprising:

fastening the connector base to a building wall.

The invention claimed is:

1. A building panel mounted to a building wall, the building panel comprising:

a front panel wall;

a plurality of side panel walls extending along a perimeter of the front panel wall; and a plurality of back mounting flanges, each back mounting flange extending from a respective side panel wall of the plurality of side panel walls, each back mounting flange overhanging the front panel wall, each back mounting flange extending in length from a first flange end to a second flange end, the plurality of back mounting flanges including at least a first back mounting flange and a second back mounting flange, and the first flange end of the first back mounting flange including a flange protrusion received in a flange recess of the second flange end of the second back mounting flange.

2. The building panel of claim 1, wherein each side panel wall extends orthogonally to the front panel wall.

3. The building panel of claim 1, wherein each back mounting flange extends orthogonally to the respective side panel wall.

4. The building panel of claim 1, wherein each flange end of each back mounting flange is adjacent the first or second flange end of another of said back mounting flanges forming an adjacent pair of flange ends.

5. The building panel of claim 4, wherein in each adjacent pair of flange ends, a flange protrusion of one flange end is received in a flange recess of another flange end.

6. The building panel of claim 1, wherein the flange protrusion is shaped to mate with the flange recess.

7. The building panel of claim 1, wherein a shape of the flange recess is the negative of a shape of the flange protrusion.

8. A method of forming a panel, the method comprising:

providing a flat panel blank having a front panel wall and a plurality of peripheral panel portions extending along a periphery of the panel blank, the front panel wall and the peripheral panel portions being coplanar, each peripheral panel portion including a side panel wall inboard of a back mounting flange, each back mounting flange extending in length from a first flange end to a second flange end, each of the first and second flange ends of each back mounting flange including at least one of a flange protrusion and a flange recess;

for each peripheral panel portion, folding the back mounting flange relative to the side panel wall, and folding the side panel wall relative to the front panel wall to form a U-shaped channel; and engaging the flange protrusions and flange recesses of adjacent flange ends of adjacent back mounting flanges.

9. The method of claim 8, further comprising:

for each peripheral panel portion, forming a first fold line between the side panel wall and the front panel wall.

10. The method of claim 9, wherein:

said folding the side panel wall relative to the front panel wall comprises folding the side panel wall along the first fold line.

11. The method of claim 8, further comprising:

for each peripheral panel portion, forming a second fold line between the side panel wall and the back mounting flange.

12. The method of claim 11, wherein:

said folding the back mounting flange relative to the side panel wall comprises folding the back mounting flange along the second fold line.

* * * * *